US010610031B1

(12) United States Patent
Edwards et al.

(10) Patent No.: US 10,610,031 B1
(45) Date of Patent: Apr. 7, 2020

(54) MODULAR RETAIL DISPLAY SYSTEM

(71) Applicant: Apple Inc., Cupertino, CA (US)

(72) Inventors: Joshua Robert Edwards, Santa Cruz, CA (US); Moritz Wilsberg, Menlo Park, CA (US); Russell John Kaaihue Heirakuji, Cupertino, CA (US); Allison Inouye, San Francisco, CA (US); Kenneth Luong, Cupertino, CA (US); Jean-Marc Gady, Los Altos, CA (US); Alice Marlin Brugger, San Francisco, CA (US); Manuel Dejesus, San Francisco, CA (US); Wesley Bryan Hamm, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/446,223

(22) Filed: Jun. 19, 2019

Related U.S. Application Data

(60) Provisional application No. 62/806,653, filed on Feb. 15, 2019, provisional application No. 62/738,785, filed on Sep. 28, 2018.

(51) Int. Cl.
*A47F 3/14* (2006.01)
*A47B 37/00* (2006.01)

(52) U.S. Cl.
CPC ..... *A47F 3/142* (2013.01); *A47F 3/145* (2013.01); *A47B 37/00* (2013.01)

(58) Field of Classification Search
CPC ..... A47F 3/142; A47F 3/145; A47F 3/007; A47B 13/12; A47B 13/14; A47B 2013/125; A47B 37/00
(Continued)

(56) References Cited

U.S. PATENT DOCUMENTS 2,683,639 A * 7/1954 Brenny ..... A47B 3/0912 108/132
4,841,878 A * 6/1989 Kriegsman ..... A47B 13/12 108/62

(Continued)

FOREIGN PATENT DOCUMENTS

DE 20 2012 103643 10/2012
DE 202018107260 U1 * 1/2019 ..... A47B 13/12

OTHER PUBLICATIONS

Invitation to Pay Additional Fees with Communication Relating to the Results of the Partial International Search for PCT Application No. PCT/US2019/052201, European Patent Office, dated Nov. 6, 2019, 12 pages.

*Primary Examiner* — Daniel J Rohrhoff
(74) *Attorney, Agent, or Firm* — Sterne, Kessler, Goldstein & Fox P.L.L.C.

(57) ABSTRACT

A retail display table includes a table top with openings, and a modular display mat disposed over each opening. Each of the modular display mats is movable between a closed position in which it covers its respective table-top opening, and an open position in which it is lifted above the table top so that a cavity underneath the modular display mat is accessible. Also, each modular display mat has holes to accommodate a configuration of displayed items, and is removable and replaceable with another modular display mat having a different configuration of holes to accommodate a different configuration of displayed items. A retail display system may include such a retail display table, along with other modular retail fixtures such as display walls with modular display wall inserts and retail counter units with modular display mats interchangeable with those of the retail display table.

23 Claims, 23 Drawing Sheets

(58) Field of Classification Search
USPC ..... 312/234
See application file for complete search history.

(56) References Cited

U.S. PATENT DOCUMENTS

| | | | | |
|---|---|---|---|---|
| 5,038,506 | A * | 8/1991 | Liljeqvist | G09F 15/00 186/37 |
| 6,530,490 | B1 * | 3/2003 | Kosann | A47F 5/0018 211/189 |
| 8,051,783 | B1 * | 11/2011 | Hoskinson | A47B 37/00 108/23 |
| 9,615,677 | B2 * | 4/2017 | Trinh | A47F 5/0087 |
| 9,954,386 | B2 * | 4/2018 | Schwalbach | A47F 7/022 |
| 2007/0290585 | A1 * | 12/2007 | Moeller | A47F 3/004 312/234 |
| 2009/0165680 | A1 * | 7/2009 | Bakker | A47B 21/06 108/50.02 |
| 2009/0276319 | A1 * | 11/2009 | Lungu | G06Q 30/02 705/14.73 |
| 2011/0062294 | A1 | 3/2011 | Johnson | |
| 2012/0001526 | A1 * | 1/2012 | Simondi | A47F 7/08 312/234.1 |
| 2013/0061783 | A1 * | 3/2013 | Bennie | A47B 21/06 108/25 |
| 2016/0064995 | A1 * | 3/2016 | Schwalbach | A47F 7/022 320/108 |
| 2017/0049253 | A1 * | 2/2017 | Agnoli | A47F 3/004 |
| 2017/0280513 | A1 * | 9/2017 | Nam | F24C 7/083 |
| 2019/0197925 | A1 * | 6/2019 | Tewksbury | G09F 9/3026 |

* cited by examiner

MODULAR RETAIL DISPLAY SYSTEM

CROSS-REFERENCE TO RELATED APPLICATIONS

This application claims priority to U.S. Provisional Patent Application No. 62/738,785, filed Sep. 28, 2018, titled "Modular Retail Display System" and to U.S. Provisional Patent Application No. 62/806,653, filed Feb. 15, 2019, titled "Modular Retail Display System," each of which is incorporated herein in its entirety by reference thereto.

FIELD

The described embodiments relate generally to retail display systems. More particularly, the present embodiments relate to modular retail display systems and components.

BACKGROUND

Retail stores and other retail environments may include furniture, shelving, tables, and other fixtures to display and showcase merchandise. These environments often utilize customized fixtures and arrangements that are fixed in configuration, and that are not easily adaptable to re-configuration, re-arrangement, or re-purposing, and that may not work in multiple types of environments.

SUMMARY

Embodiments of the present invention include retail display systems with a high level of modularity. For example, a retail display table includes a frame and a table top within and supported by the frame. The table top has openings therethrough, and the retail display table includes a modular display mat disposed over each opening. The openings may be rectangular. Each of the modular display mats is movable between a closed position in which it covers its respective table-top opening, and an open position in which it is lifted above the table top so that a cavity underneath the modular display mat is accessible. Also, each modular display mat has a configuration of holes therethrough to accommodate a configuration of displayed items, and is removable and replaceable with another modular display mat having a different configuration of holes to accommodate a different configuration of displayed items.

The retail display table may include a lift tray in each of the table-top openings. Each of the modular display mats may be coupled to one of the lift trays such that each lift tray lifts and lowers its respective modular display mat to move the modular display mat between the open and closed positions. A cable of the displayed items may extend through one of the holes in the modular display mats. In the closed position, the cable may be hidden from view. In the open position it may be accessible.

The table top of the retail display table may be flat and finished on both a top side surface and a bottom side surface, and may be reversible relative to the frame so that the top side surface can become the bottom side surface and the bottom side surface can become the top side surface. In an undamaged state, the bottom side surface of the table top may have the same appearance as the top side surface of the table top.

The retail display table may also include table legs connected to and supporting the frame. Each of the table legs has an inward-facing surface that faces an area under the table top, and an outward-facing surface that faces outward from the retail display table. Each of the table legs may be reversible relative to the frame so that its outward-facing surface can become an inward-facing surface, and its inward-facing surface can become an outward-facing surface. In an undamaged state, the outward-facing surfaces may have the same appearance as the inward-facing surfaces. The external surface of each table leg at a horizontal cross-section therethrough may define a shape with an order of rotational symmetry of 2.

The retail display table may also include a non-mat modular element disposed within one of its openings, where the non-mat modular element is swappable with each of the modular display mats. The non-mat modular element may be, for example, a recessed display cavity covered with a transparent cover.

A retail display system may include, for example, the retail display table and replacement table tops and replacement modular display mats. The retail display system may also include a non-table display fixture including a display surface having openings therethrough and modular display mats disposed over the openings of the display surface. Each of the modular display mats of the non-table display fixture can be swapped with any of the modular display mats and replacement modular display mats of the table to reconfigure the non-table display fixture. The non-table display fixture may be a counter unit or a display wall, for example.

A display wall of the retail display system may include a display wall frame, a display wall insert disposed vertically within the display wall frame, and a replacement display wall insert having a different configuration from the display wall insert. The display wall insert and the replacement display wall insert can be swapped with each other to reconfigure the display wall.

The retail display system may also include modular floor tiles, each including a flat upper surface and circular supports extending downward from and supporting the flat upper surface. The retail display system may also include a cable disposed under the modular floor tiles, the cable traversing between the circular supports, where the cable provides power to the table and/or other modular retail fixtures (e.g., a counter unit or a display wall).

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
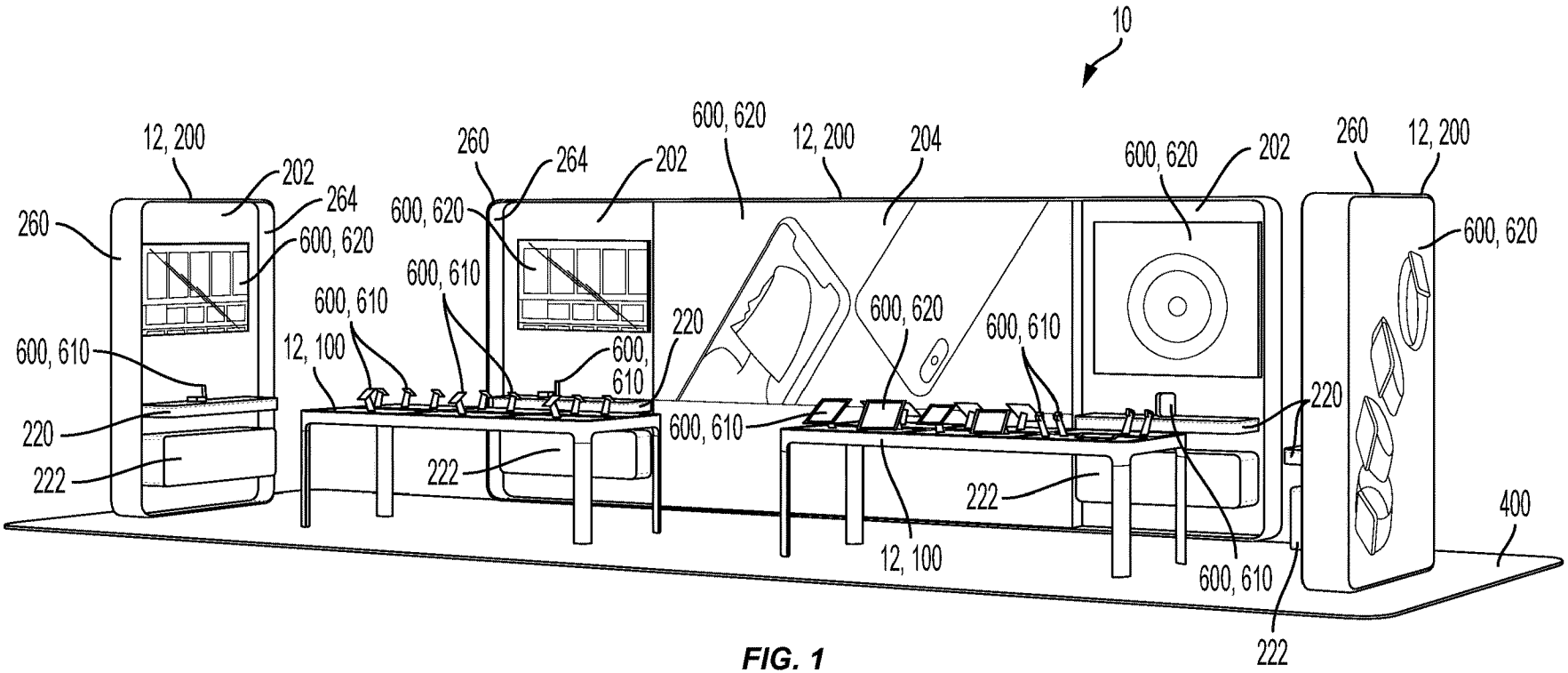
FIG. 1 shows a perspective view of a retail display system.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

The following disclosure relates to a retail environment, which can be arranged, for example, within a larger retail environment, such as a retail store. It can create a defined space in which particular product-types or brands are displayed. For example, the retail environment may provide a company-branded space (e.g., Apple) inside a retail box store (e.g., Best Buy or Target) or service provider store (e.g., AT&T or Verizon).

The retail environment may include a floor system that helps define its retail space.

The floor system can provide a continuous distinct appearance, and may define an outer boundary of the retail space. The floor system may also help maintain a neat and uniform appearance to the retail space. For example, it may include a wire management system such that the wires and cables are hidden from view. The floor system can also include carpet tiles and edging to create a uniform appearance. This may be beneficial in a store environment where the floor helps define a dedicated retail space within the store.

The retail environment may include one or more display units (e.g., display walls) that are positioned within the retail space, on the floor system. These units may be freestanding, mounted to the floor, mounded to a wall, or mounted to both the floor and a wall. These units may connect to power and data invisibly to a customer, through cables running under the floor. The display units may form barriers or walls that help define a contained area defining the retail space and separating it from the rest of the environment (e.g., the rest of the store). The display units can be widely varied, including tables, counter units, and display walls. In some examples, the display units can include graphic panels (e.g., to advertise products), monitors, counters, product hangers, and/or storage cabinets. The display units can come in various sizes to accommodate some or all of these features and more.

Additionally or alternatively, the retail environment may include one or more tables positioned within the retail space, on the floor system. These tables may also connect to power and data invisibly to a customer, through cables running under the floor. The tables may themselves be display units, in that they may be used to showcase merchandise, or the tables may be used for work or demonstration areas. The tables may, for example, be positioned adjacent to the display units. In fact, the tables may work with or cooperate with the display units to create the desired retail environment. The tables and the display units may be referred to as retail fixtures, and together they can be placed to create pathways through the retail space, and to arrange merchandise, advertising, work areas, collaboration areas, demonstration areas, and more in a desired configuration to create different retail environments depending on the needs of the retail space or store.

Such retail environments and spaces therein may be regularly reconfigured. This may be to accommodate a new product, a seasonal change, or a new retail strategy. For example, a retail display table may include tabletop display fixtures such as product display stands and signage. The positions of such tabletop display fixtures may be specific to the product being displayed, and may be dictated by a template so that products are displayed similarly throughout the store, and among retail stores at different locations. This consistency can help maintain a desired appearance and layout among stores.

Setting up or changing over an existing product layout may require careful measuring and placement of tabletop display fixtures according to a template, and procedures to individually affix each tabletop display fixture in position. There may be significant time constraints on such setup or changeover—for instance, an entire store may have to be changed over in a single night so as not to interfere with regular business hours. The complexity of and time constraints on such setups and changeovers mean that they are often done by teams of specialists, not a store's regular retail employees. The need for teams of specialists can limit the speed at which a large company can changeover all of its stores simultaneously.

Figure 3:
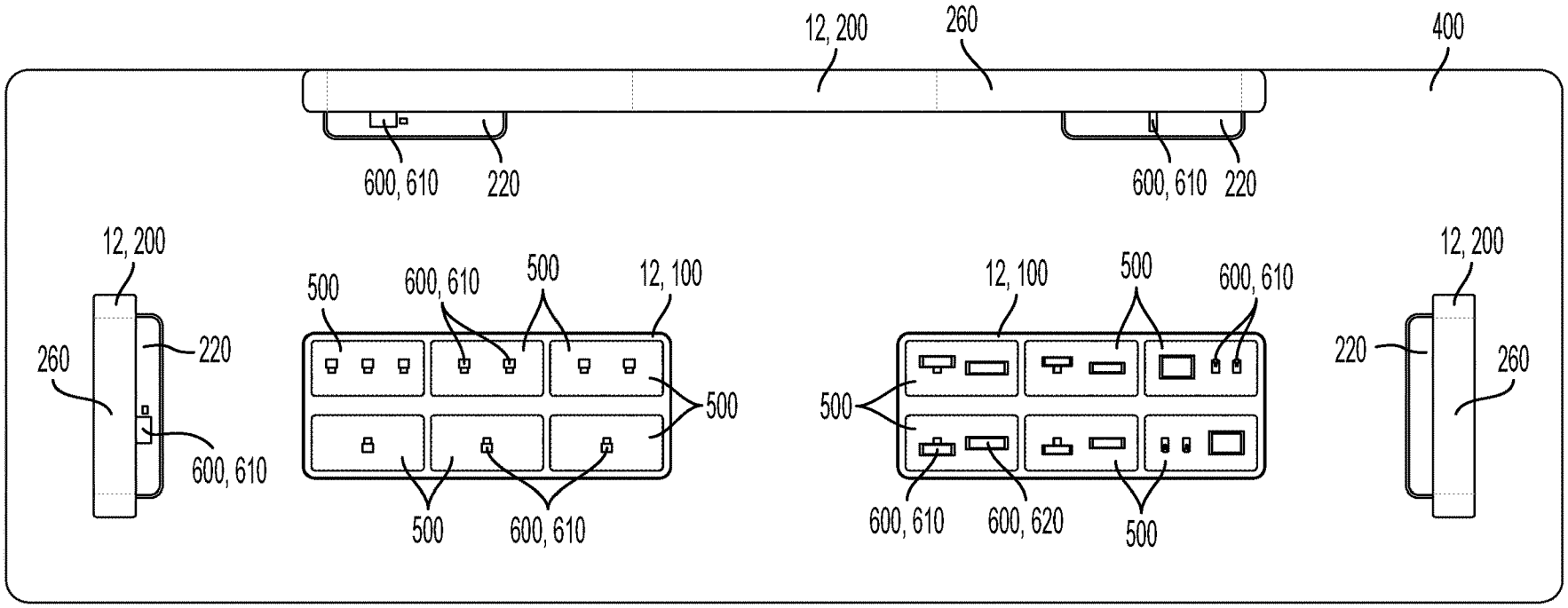
FIG. 3 shows a top view of the retail display system of FIG. 1.
Figure 4:
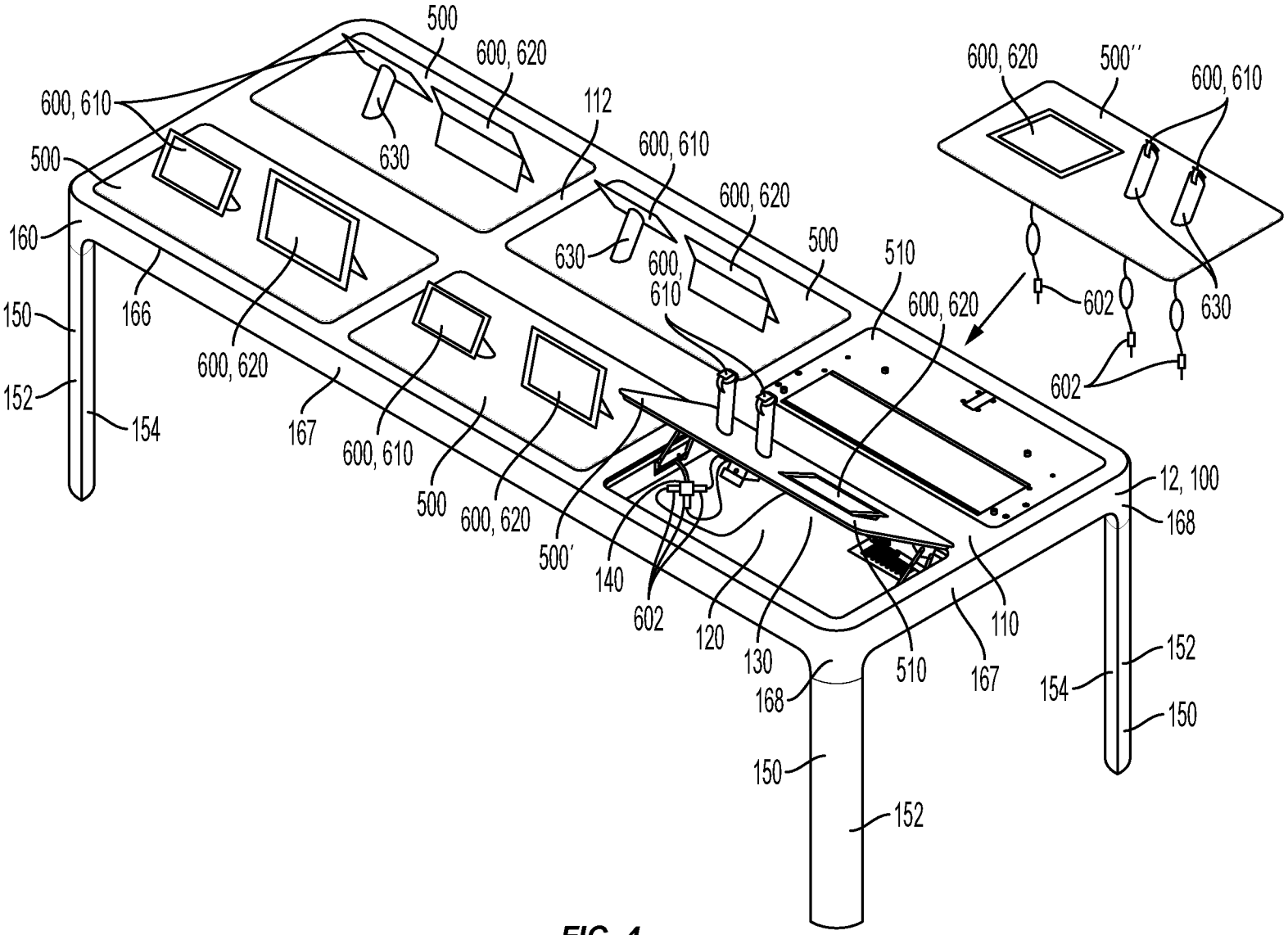
FIG. 4 shows a perspective view of a retail display table of FIG. 1.

The inventors have developed a modular retail display system that simplifies the process of changing over a store and reduces the time it takes. In this modular retail display system, fixtures and parts of fixtures can be removed and replaced with ease and without special training, to allow easy configuration or reconfiguration of a retail space. This reduces cost and downtime that may be associated with less modular retail display systems that may require specialized training and longer times to effect reconfiguration. It also extends the useful life of system fixtures because they can be reconfigured or repaired without being replaced entirely. For example, a retail display table of this system has rectangular openings for each product display area. A table may have, one or more of these areas (for example six—three on each side—as shown in FIGS. 3 and 4. Covering those openings are modular display mats. Tabletop display fixtures are mounted to the modular display mats. Such tabletop display fixtures may be, for example, product display stands. For example, a product display stand may have a stem that holds a product at its end, raised above the modular display mat so that a customer can interact with and experience its displayed product. Wires may run through the display stand to deliver power or data to the product. The modular display mats may be lifted up so that wires from the products or other display components on the modular display mats that extend through holes in the modular display mats can be connected to power or data within the table. These connections are concealed when the modular display mat is replaced over the table opening.

The modular display mats are easy to install, so they can be shipped to a store pre-configured (e.g., drilled for receiving tabletop display fixtures at the right locations, or pre-assembled with tabletop display fixtures already mounted). Then, a retail employee with no special training can simply install the modular display mat over one of the retail display table's openings in a matter of minutes. The ease with which these modular display mats can be installed makes reconfiguring a store easier, either by replacing old modular display mats with new ones shipped in, or by swapping positions of existing modular display mats to achieve a new look. Also, if a single modular display mat gets damaged, it can be quickly replaced individually without having to disturb other modular display mats that have not been damaged.

The system not only allows quick and easy changeover of tabletop display fixtures, but also of individual modular parts of its display fixtures, such as retail display tables, display walls, and counter units. This modularity provides additional dimensions to store reconfiguration, allowing the store to be maximally reconfigured in minimal time and with minimal expertise.

These and other embodiments are discussed below with reference to the figures. However, those skilled in the art will readily appreciate that the detailed description given herein with respect to these figures is for explanatory purposes only and should not be construed as limiting.

Figure 2:
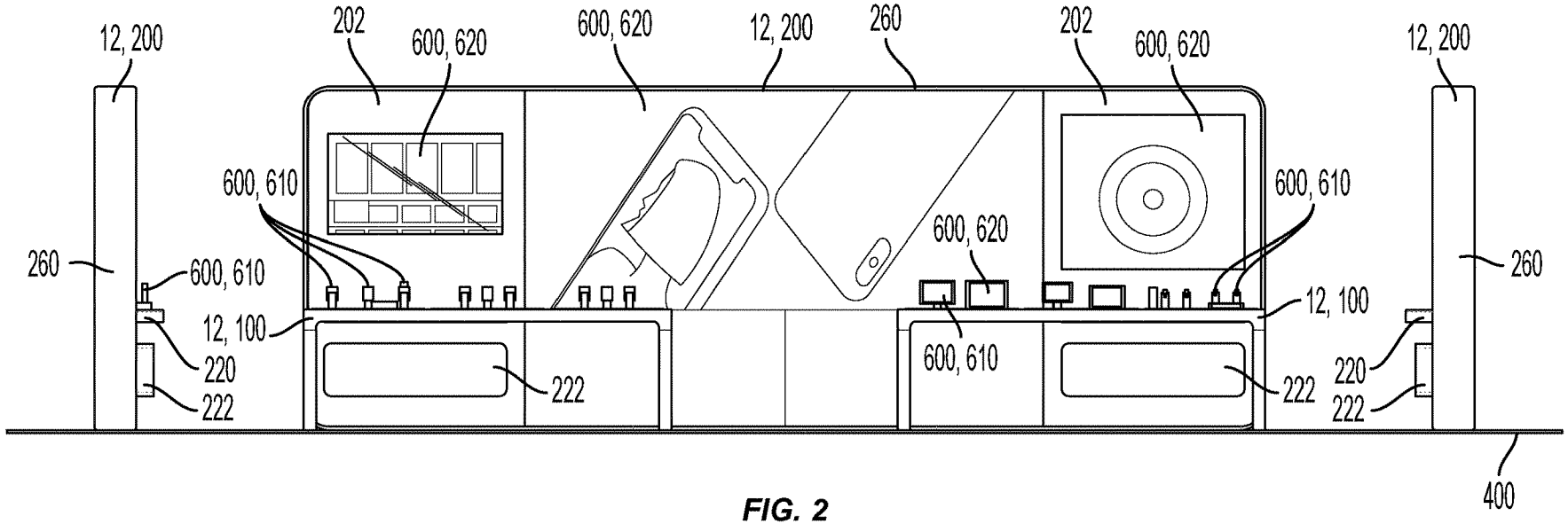
FIG. 2 shows a front view of the retail display system of FIG. 1.

FIGS. 1-3 illustrate an example store layout according to an embodiment of the invention. FIG. 1 is a perspective view, FIG. 2 is a front view, and FIG. 3 is a top view.

As shown, the store layout includes a retail display system 10 that defines a retail environment made up of modular retail fixtures 12. Modular retail fixtures 12 may include one or more retail display tables 100 and display walls 200, as shown. Modular retail fixtures 12 may include other fixtures, such as, for example, counter units 300 (see FIG. 8).

Retail display system 10 may also include floor system 400. Floor system 400 may be made up of floor tiles that can include pathways for unobtrusively providing power and/or data to modular retail fixtures 12. Floor system 400 may be formed of subfloor tiles, carpet tiles on the subfloor tiles, and boundary edging, as will be described in more detail later.

Modular retail fixtures 12 may be used to display products and information about them, and to demonstrate product capabilities. For example, as shown in FIGS. 1-3, each modular retail fixture 12 is shown with displayed items 600, including a product 610 or demonstration/information device 620. Products 610 may be, for example, items displayed for sale, whether for sale themselves or as representative display models (i.e., representative of a packaged item available for purchase and stored elsewhere). Such items may be, for example, smartphones, smartwatches, computers, tablet computers, cameras, video game systems, digital media players, entertainment systems, speakers, headphones, earphones, and the like. Demonstration/information devices 620 may be, for example, a tablet computer or display monitor (e.g., television) that demonstrates capabilities of an associated product 610 or a placard that conveys information (e.g., specifications, advertising) about an associated product 610.

Such displayed items 600 may be displayed in specific arrangements, according to a desired layout of a modular retail fixture 12 or even of an entire store or retail area. Consistent arrangements can promote an orderly and planned appearance and can reflect a consistent look internally within a store and externally across multiple stores (e.g., stores of the same company or brand).

As shown in FIGS. 1-3, modular retail fixtures 12 include tables 100 and display walls 200. Each of tables 100 and display walls 200 can have power and data capabilities, including internal wiring and plugs that can provide power and data connections to their components or to displayed products 610 or demonstration/information devices 620. Yet there are no apparent power or data cables connected to any of tables 100 or display walls 200. Such power and data connections are made invisibly, by cables that run within floor system 400. For example, cables may run through a leg of each table 100 (as explained in more detail below), or through an underside of each display wall 200. This keeps the retail environment clear of cables and helps it maintain a neat and professional appearance.

Modular retail fixtures 12 may have many features to perform their various functions. For example, display walls 200 may include demonstration/information devices 620, which may be, for example as shown in FIGS. 1 and 2, display monitors (e.g., televisions), graphic light boxes (e.g., with advertising), or full graphic panels. Display walls 200 may further include display counters 220, cabinets 222, display hooks 224, display shelves 226 (see FIG. 6), or other features to facilitate display of products 610 or related information. The features of display walls 200 may have some correspondence with features of tables 100. For example, the height of a top surface of a display counter 220 may be the same as the height of a top surface of a table 100.

The features of display walls 200 may also share visual characteristics, such as their outer shapes. For example, display counters 220, cabinets 222, and outer frames 260 of display walls 200 itself may share a similar appearance in having significantly rounded corners. The rounded bottom corners of outer frames 260 help emphasize the vertical appearance of display walls 200 rising up from and sitting atop floor system 400. Tables 100 have similar rounded edge profiles, for example along the outer and inner sides of their legs, thereby further tying the appearance of the modular retail fixtures 12 together to help define a cohesive retail environment. Likewise, floor system 400 may also share a similar outer profile with significantly rounded corners. Again, this may help to define a cohesive retail environment. The shapes and appearances of modular retail fixtures 12 and floor system 400 may be varied widely to achieve different visual appearances. For example, rather than being rounded, corners of the modular retail fixtures 12 and floor system 400 could have a squared or chamfered shape, among other shapes.

Display walls 200 may include flush areas 204 that are aligned with a front edge of their frames 260 (e.g., flush area 204 including a graphic panel such as shown in FIGS. 1 and 2). Display walls 200 may alternatively or additionally include recessed areas 202 set in from a front edge of their frames 260. Such recessed areas 202 provide a further defined area within which to showcase displayed items 600, for example with a display monitor and a shelf with an example of merchandise for sale, thereby providing an effective way for customers to interact with and learn about the merchandise.

To help further define and set apart recessed areas 202, exposed inner-side surfaces 264 of their frames 260 may have a different appearance than outer surfaces of frames 260. For example, frames 260 may be generally formed of metal and have a colored (e.g., white) or metallic (e.g., brushed aluminum) appearance, but exposed inner-side surfaces 264 may be have a different appearance, such as a wood-grain appearance. This may be achieved by wood-laminate panels set atop or within channels of outer frame 260. Similar contrast in appearance may be effected in other ways among modular retail fixtures 12. For example, top surfaces of tables 100 and counters 220 may have a wood-grain appearance, which may contrast with a colored (e.g., white) or metallic (e.g., brushed aluminum) appearance of their frames.

At times, a retailer may desire to replace displayed items 600 in a way that is consistent with other displayed items 600, or may desire to reconfigure the arrangement of displayed items 600 in a consistent way or to replace currently displayed items 600 with new displayed items 600 in a new consistent arrangement. Rather than requiring tedious and time-consuming measuring and making attendant modifications to retail display fixtures on which displayed items 600 are displayed, modular retail fixtures 12 include features that make reconfigurations easier, faster, and more convenient.

FIG. 4 shows a retail display table 100, which is a free-standing display fixture. Retail display table 100 may have a continuous flat top surface, or it may be broken up into one or more display areas (e.g., six display areas are shown in FIG. 4). The display areas are defined by modular mats 500 that appear to be situated on the top surface of retail display table 100. In some embodiments, each modular display mat 500 is disposed over an opening in the retail display table 100 in which it is installed. For example, retail display table 100 may have six such openings 120 in its table top 110 (two of which are shown in FIG. 4). Together, table top 110 and modular display mats 500 form the top surface of an assembled retail display table 100 when all modular display mats 500 of the retail display table 100 are in the closed position. The shapes and sizes of openings 120 and modular display mats 500 may correspond. As shown, they are both rectangular, however they could also have other shapes, such as square or circular, for example. Modular display mats 500 may protrude from their corresponding openings 120, or they may be flush with or recessed relative to the upper surface of table top 110. In some embodiments, modular display mats 500 may have an upper lip that rests on table top 110 around openings 120. A modular display mat 500 may be sized and dimensioned so that at least a portion of it corresponds to the size and dimension of an opening 120 so that the modular display mat 500 fits closely and securely within the opening 120. The position of a modular display mat 500 over or within an opening 120 may be maintained by a mechanical connection (e.g., a hinge, detents, a snap-fit, a friction fit), by close correspondence between the shape of a portion of a modular display mat 500 and its corresponding opening 120, or by magnetic attraction of magnets connected to modular display mat 500, table top 110, or both.

To facilitate modular reconfiguration of modular retail fixtures 12, each modular display mat 500 is modularly removable and replaceable over openings 120, and can be affixed in position to lift trays 510 disposed within openings 120. Modular display mats 500 can be hingedly affixed, such that they can move between open and closed positions relative to retail display table 100. In FIG. 4, modular display mat 500' is shown in the open position, and modular display mat 500" is shown uninstalled. The other modular display mats 500 shown in FIG. 4 are in the closed position.

In the open or uninstalled position, an interior cavity 130 of retail display table 100 is accessible. Within interior cavity 130 may be hardware or other infrastructure to facilitate operation of retail display table 100, including, for example, power and/or data connections 140. An installer may access interior cavity 130 to plug displayed items 600 into power and/or data connections 140 via cables 602 of displayed items 600.

Figure 5:
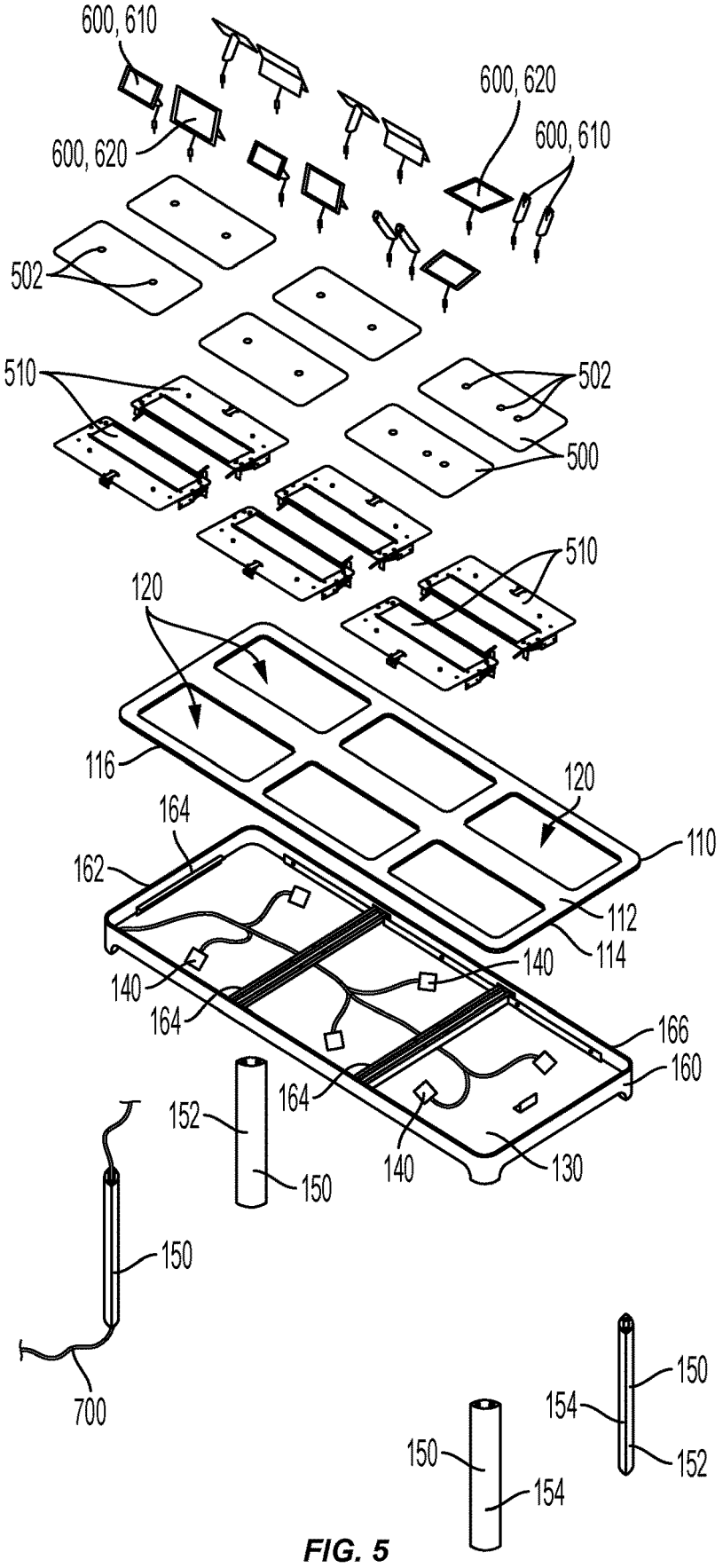
FIG. 5 shows an exploded perspective view of the retail display table of FIG. 4.

Each modular display mat 500 may include a configuration of holes 502 therethrough (see, e.g., FIG. 5). Each hole 502 may be positioned at the desired location of a corresponding displayed item 600, which may be affixed to modular display mat 500 over hole 502. Hole 502 thereby provides access through modular display mat 500 for passing through a cable 602 of displayed item 600 to connect it to power and/or data connection 140 of retail display table 100.

As shown, for example, in FIGS. 4 and 5, displayed items 600 may be attached to an item display fixture 630, such as a display stand. For example, an item display fixture 630 may have a stem that holds a product 610 at its end, raised above a modular display mat 500 so that a customer can interact with and experience its displayed product 610. Item display fixture 630 may be designed to support and/or secure its displayed item 600 relative to itself, and item display fixture 630 may itself be fixed in place to modular display mat 500. In this way, modular display mats 500 may be assembled and shipped to a store for use or replacement with item display fixtures 630 already attached in the correct positions, and store employees can secure products 610 to display fixtures 630 when setting up an associated modular retail fixture 12 such as retail display table 100.

Lift trays 510 may be disposed within a respective opening 120 by a connection to frame 160. The connection to frame 160 may be effected by reversible common fasteners such as, for example, machine screws. Modular display mats 500 may be connected to lift trays 510 via a reversible common fastener, such as by one of more machine screws or clips. In some embodiments, modular display mats 500 have a catch along the rear of their bottom side that slots under a portion of a lift tray 510 to secure the rear side, so that modular display mat 500 can be secured to lift tray 510 by fasteners at the front of its bottom side, where they are more easily accessible to an installer.

Modular display mats 500 may be secured in a closed position by a latch. In a removal operation, an installer may un-latch a modular display mat 500 and rotate it into the open position. In some embodiments modular display mat 500 is maintained in the open position automatically upon being opened or unlatched (e.g., by a gas strut lift support, a prop rod, or other mechanism). In the open position, cables 602 within interior cavity 130 are accessible to the installer through opening 120. The installer may un-plug cables 602 from power and/or data connection 140 so that displayed items 600 are free from cabled connection to retail display table 100. Then the installer may un-screw bolts (or other fixing mechanism) that connect modular display mat 500 to lift tray 510 so that modular display mat 500 is free from connection to retail display table 100. In some embodiments, the latch may include a lock such that only authorized personnel may access interior cavity 130.

In a replacement (or an initial placement) operation, an installer may essentially reverse the removal operation. He or she may obtain a new or replacement modular display mat 500 (e.g., one with a different configuration of holes for accommodating a different configuration of displayed items 600), including displayed items 600 already fixed in place (or if they are not pre-fixed in place, the installer may fix them in place to modular display mat 500). The installer may then place modular display mat 500 over opening 120 and lift tray 510. The installer may connect modular display mat 500 to lift tray 510 (e.g., by screwing in bolts to establish mechanical connection between modular display mat 500 and lift tray 510). Modular display mat 500 may now be hingedly movable relative to retail display table 100 between the open and closed position. The installer may maintain modular display mat 500 in the open position and may then plug cables 602 of displayed items 600 into power and/or data connection 140 to establish a power and data connection between retail display table 100 and displayed items 600. The installer may then lower modular display mat 500 into the closed position and latch it in place such that interior cavity 130 and cables 602 are hidden from view.

Lift trays 510 may be alarmed so that unauthorized opening of modular display mats 500 can be detected and discouraged. For example, each lift tray 510 may include an alarm sensor that detects when the lift tray 510 is moved to the open position. If the alarm has not been disabled (e.g., by an authorized user entering a code or using a key), then the alarm may send a signal that lift tray 510 has been opened without authorization. This signal may be audible at the location of the opened lift tray 510 (e.g., at the retail display table 100 in which it is installed), and/or it may be transmitted to a remote monitoring device that can alert the appropriate person.

In some embodiments, a unit other than a modular display mat 500 and lift tray 510 may be disposed within an opening 120 of table top 110. For example, such a non-mat modular element may be a recessed display cavity topped with a transparent (e.g., glass) cover, and with products 610 displayed inside. Such a non-mat modular element may be interchangeable with modular display mats 500 as described above. For example, modular display mats 500 and their associated lift trays 510 may be disposed within first openings 120 of a retail display table 100, and a non-mat modular element may be disposed within a second opening 120 of the same retail display table 100. In the case that a retailer wishes to reconfigure the retail display table 100, he or she may swap the non-mat modular element with one of the modular display mats 500 such that the non-mat modular element is positioned in one of the first openings 120 and one of the modular display mats 500 is positioned in the second opening 120.

Because retail display tables 100 may often be used in a retail location where customers can examine displayed items 600, there may be times that a retail display table 100 becomes damaged. For example, modular display mat 500 or table top 110 may become scratched or dented (e.g., by dropping a heavy item on it), a table leg 150 may become scratched or dented (e.g., by running into it with a shopping cart). In the case of a damaged modular display mat 500, the modular display mat 500 can be easily and quickly replaced with a replacement modular display mat 500 in the manner described above, without the need for a specially-trained technician or significant downtime. The old modular display mat 500 can be refurbished (e.g., sent back to an offsite refurbisher) to be reconfigured and re-used. In some embodiments, each modular display mat 500 can be refurbished, reconfigured, and reused multiple times, and is formed of recyclable material (e.g., a cellulose-based material such as HPL (High-Pressure Laminate)) so that at the end of its life it can be recycled.

In some embodiments, table top 110 is flat and finished on both sides. That is, it is finished on its top side surface 112 (viewable in the assembled retail display table 100, see FIG. 4) and its bottom side surface 114 (hidden in the assembled retail display table 100, facing interior cavity 130, see FIG. 5). For example, both top side surface 112 and bottom side surface 114 have undergone a finishing operation such that their appearance is visually improved and protected (e.g., by a flattening/smoothing operation such as planing or sanding, and/or by the application of a stain or paint or other appearance-changing substance, and/or by the application of a protective coating such as lacquer or varnish. Both top side surface 112 and bottom side surface 114 may be veneered. In some embodiments, table top 110 may have an appearance that contrasts with that of other visible parts of table 100, such as frame 160 and modular display mats 500. For example, table top 110 may have a wood-grain appearance, while other visible parts of table 100, such as frame 160 and modular display mats 500, may have a colored (e.g., white) or metallic (e.g., brushed aluminum) appearance. In some embodiments, table top 110 may have an appearance that matches an appearance of inner side surfaces 264 of display walls 200 (e.g., both may have a wood-grain appearance) and other visible parts of table 100, such as frame 160 and modular display mats 500 may have an appearance that matches an appearance of exterior side surfaces of display walls 200 (e.g., both may have a colored (e.g., white) or metallic (e.g., brushed aluminum) appearance.

In the case of damage to top side surface 112, table top 110 is reversible. That is, it can be simply flipped over so that bottom side surface 114 becomes top side surface 112, and vice versa. In other words, bottom side surface 114, previously facing downward toward interior cavity 130, is now facing up. And top side surface 112, previously facing up, is now facing downward toward interior cavity 130. In an undamaged state, bottom side surface 114 of table top 110 has the same appearance as top side surface 112 of table top 110. By flipping table top 110 over in this way, any scratches, dents, or other damage to the previously-top surface are now hidden within retail display table 110, and retail display table 100 is restored to its un-damaged appearance without the need to order and wait for a new table top 110 or a specially-trained technician, thereby avoiding unnecessary cost and downtime.

Table top 110 includes a number of features to help it effect this easy reversibility. First, as mentioned above, it is finished on both sides 112, 114. It also has the same appearance on both sides 112, 114. It has a symmetrical shape, including a symmetrical positioning of its openings 120. It also does not include any attachment fixtures (e.g., fasteners, fastening holes) in either its top side surface 112 or its bottom side surface 114. Instead, it is supported by supports 164 of table frame 160 within a recess 162 of table frame 160 such that its top side surface 112 is aligned with an upper edge 166 of table frame 160 (see FIGS. 4 and 5). To stay snug within recess 162, table top 110 may include a gasket 116 around its side perimeter that presses against an interior of table frame 160 when table top 110 is installed within table frame 160.

Table frame 160 may be formed of aluminum. It may have extruded sides 167 with milled corners 168. To effect a seamless look between its extruded sides 167 and its milled corners 168, extruded sides 167 may be welded to milled corners 168 and both extruded sides 167 and milled corners 168 may be powder coated. In some embodiments, table frame 160 may be formed of or include die-cast aluminum parts.

In some embodiments, retail display system 10 may include one or more replacement table tops 110 and replacement modular display mats 500 (e.g., table tops 110 and modular display mats 500 that are not presently installed within a retail display table 100). Such replacement table tops 110 and replacement modular display mats 500 can be used to easily replace installed table tops 110 and modular display mats 500 in the same manner as described above. The replacement table tops 110 and replacement modular display mats 500 may have the same appearance as installed table tops 110 and modular display mats 500, respectively (e.g., for re-creating an original appearance, in the case of damage). The replacement table tops 110 and replacement modular display mats 500 may have different appearances or configurations (e.g., for reconfiguring a retail display table 100).

For example, a replacement table top may have fewer (or no) openings 120, to provide a larger or different work surface (e.g., with pop-up electrical outlets) or an area for a different type of product display. Also for example, a replacement modular display mat 500 may have the same outer shape as an installed modular display mat 500 (such that it is compatible with the opening 120 of the installed modular display mat 500) but a different inner configuration (e.g., different hole 502 placement, or different item display fixtures 630 attached).

As shown, for example, in FIGS. 4 and 5, retail display table 100 may include table legs 150. Table legs 150 may be connected to table frame 160 to support table frame 160 above the ground (e.g., floor system 400 or other surface on which table legs 150 are supported). Table legs 150 may also be reversible relative to table frame 160. In the case that an outer side surface of a table leg 150 is damaged, that table leg 150 may be simply removed from table frame 160 (e.g., by fasteners accessible from within table frame 160 upon removal of table top 110 as described above), rotated 180 degrees, and reattached to table frame 160 such that a previously-outward-facing surface 152 of table leg 150 now faces inward, and a previously-inward-facing surface 154 of table leg 150 now faces outward. In an undamaged state, both outward-facing surface 152 and inward-facing surface 154 of each table leg 150 have the same appearance. This way, the damaged side of the table leg 150 is no longer visible from an exterior of retail display table 100, but is hidden from view by facing inward underneath table top 110. Thus, the leg 150 of retail display table 100 is restored to its un-damaged external appearance without the need to order and wait for a new table leg 150 or a specially-trained technician, thereby avoiding unnecessary cost and downtime.

Table leg 150 includes a number of features to help it effect this easy reversibility. In some embodiments, it has a constant horizontal external cross-section. Also, the external surface of table leg 150 at any horizontal cross-section therethrough may define a symmetrical shape. For example, as shown in FIG. 5, the external surface of table leg 150 at any horizontal cross-section therethrough defines a shape with an order of rotational symmetry of two (i.e., there are exactly two positions—180 degrees apart—within a 360 degree rotation at which the shape looks the same. As shown in FIG. 5, the external surface of table leg 150 at any horizontal cross-section therethrough defines a football-like profile. This shape also allows table leg 150 to have a wide external appearance in a small footprint, and helps hide the appearance of its internal side (e.g., in the event that it shows some damage).

Table legs 150 may be extruded, and may be formed of aluminum. They may have a powder coated finish (e.g., the same finish as frame 160). In some embodiments, table legs 150 may be formed of or include die-cast aluminum parts.

Figure 6:
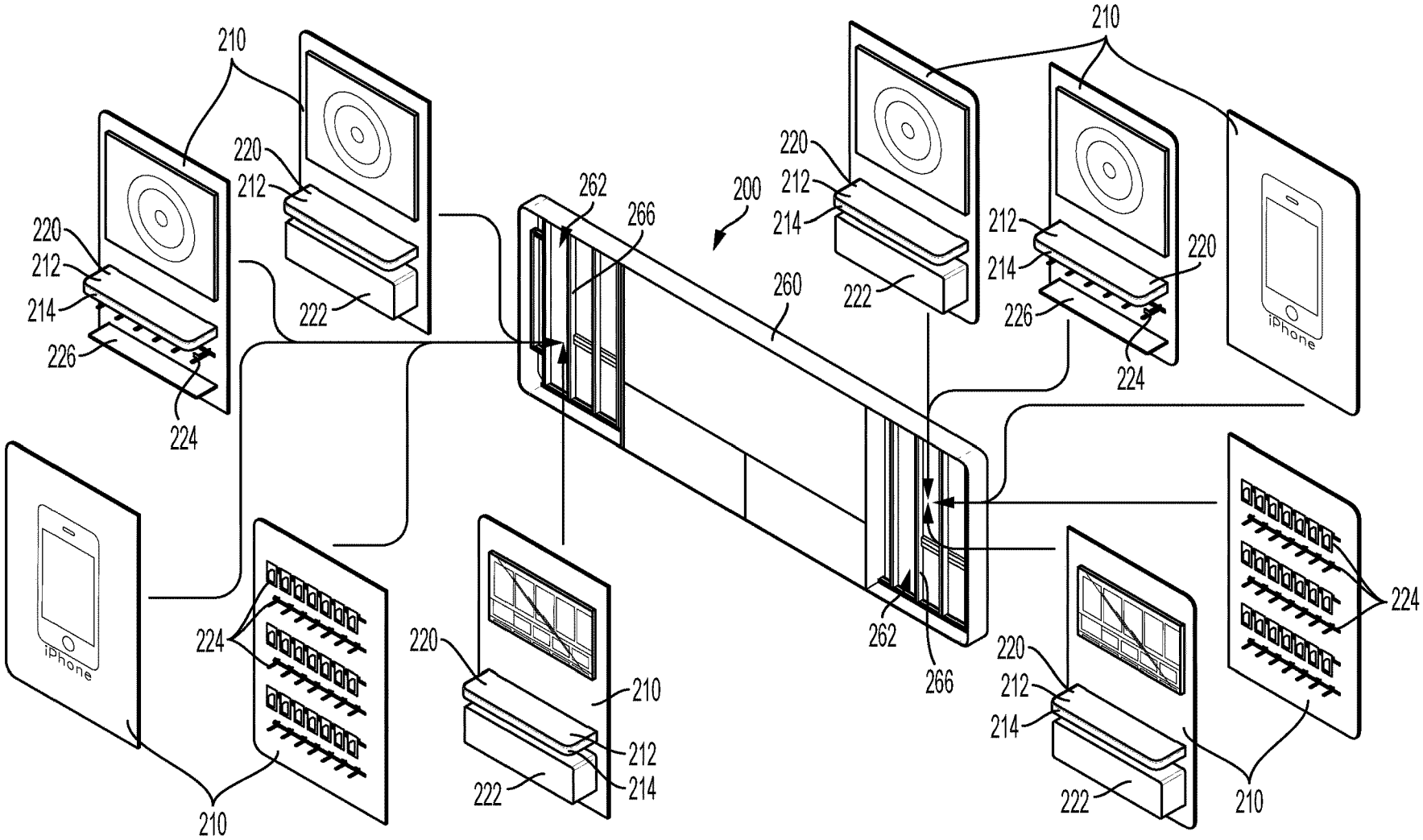
FIG. 6 shows a representation of configurations of a display wall of FIG. 1.
Figure 7:
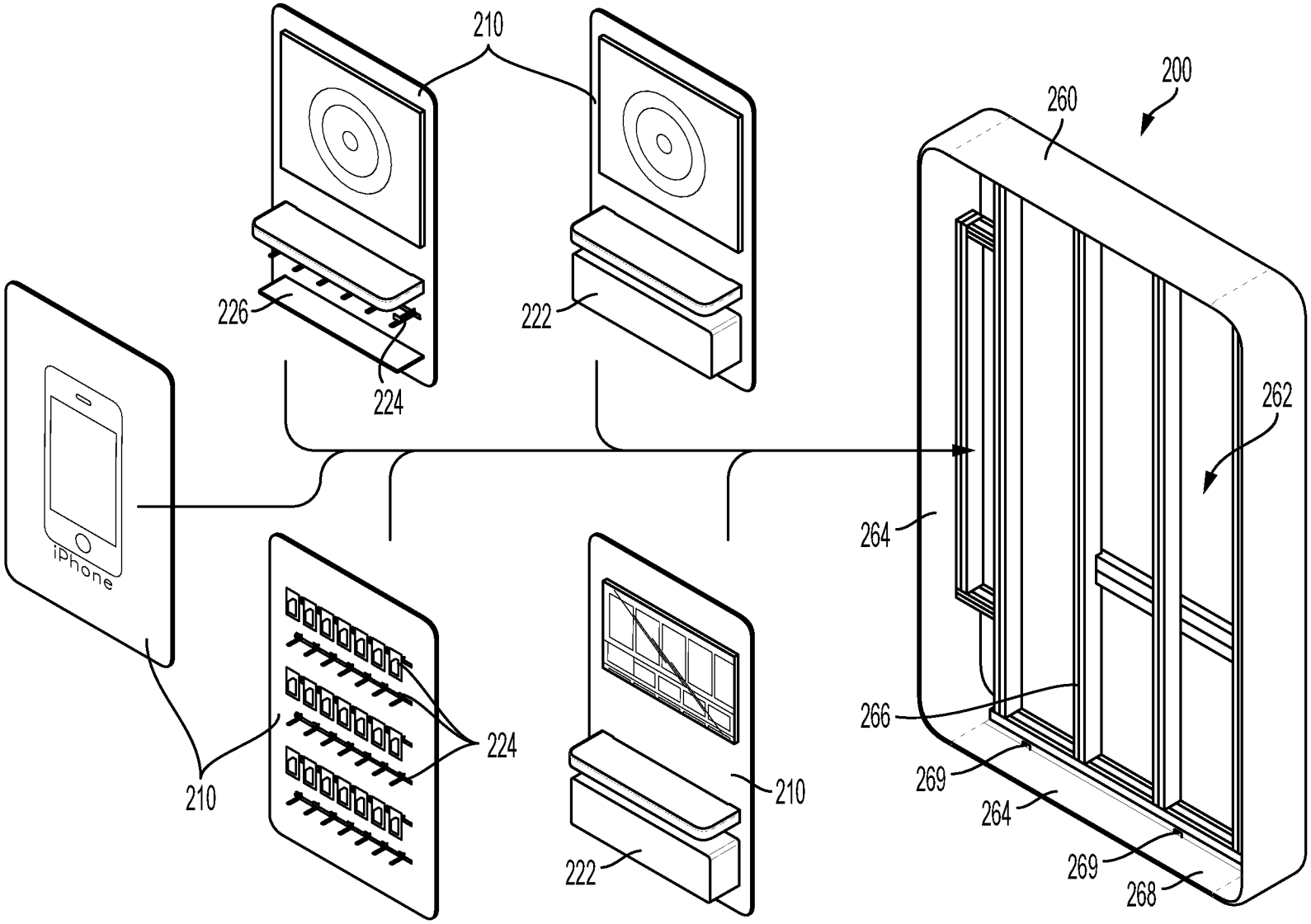
FIG. 7 shows a representation of configurations of a display wall of FIG. 1.

FIGS. 6 and 7 illustrate example display walls 200 according to embodiments of the invention. Display walls 200 may be free-standing display fixtures. Each includes a modular display wall insert 210, on which displayed items 600 may be displayed (see FIGS. 1-3). Each also includes a frame 260 that surrounds and supports its modular display wall insert 210. Frame 260 may extend around and define an exterior of display wall 200. Frame 260 may be a single integral piece, or it may be formed of multiple frame members connected together. Retail display system 10 may include multiple different modular display wall inserts 210, as shown in FIGS. 6 and 7, each with a perimeter that aligns with an interior side surface of a receiving cavity 262 of display wall frame 260. In this way modular display wall insert 210 is sized and dimensioned to be received within and framed by display wall frame 260. Some modular display wall inserts 210 may include surfaces with openings configured to receive modular display mats 500 and lift trays 510 as described above relative to retail display table 100.

In some embodiments, modular display wall inserts 210 may include a modular counter panel 212. Modular counter panel 212 may be flat and finished on both sides such that it is reversible and replaceable within a counter frame 214 of display wall insert 210 in a similar manner as described above with respect to retail display table 100. For example, if modular shelf panel is damaged, it may be reversed to restore its original appearance. As with table top 110, modular counter panel 212 may have an appearance that contrasts with that of other visible parts of its display wall 200, such as counter frame 214. For example, modular counter panel 212 may have a wood-grain appearance, while other visible parts of its display wall 200, such as counter frame 214, may have a colored (e.g., white) or metallic (e.g., brushed aluminum) appearance. In some embodiments, modular counter panel 212 may have an appearance that matches an appearance of one or more of table top 110 or inner side surfaces 264 of display walls 200 (e.g., both may have a wood-grain appearance). If a retailer desires to reconfigure displayed items 600 of modular counter panel 212 he or she may remove and replace modular counter panel 212 with a different one having a different configuration (e.g., holes in different places). Beneath modular counter panel 212 may be a cavity similar to interior cavity 130 of retail display table 100 within which cables 602 of displayed items 600 can be connected to a power and/or data connection 140.

Receiving cavities 262 of retail display system 10 may have four different shape types, depending on their position within display wall frame 260: left side (curved left-side corners, right-angled right-side corners, as shown on the left in FIG. 6), right side (curved right-side corners, right-angled left-side corners, as shown on the right in FIG. 6), centered (right-angled left-side corners and right-angled right-side corners), and solitary (curved left-side corners and curved right-side corners, as shown in FIG. 7).

In some embodiments, retail display system 10 may include one or more replacement modular display wall inserts 210 (e.g., modular display wall inserts 210 that are not presently installed within a display wall 200). Such replacement modular display wall inserts 210 can be used to easily replace installed modular display wall inserts 210 in the same manner as described above. The replacement modular display wall inserts 210 may have the same appearance as installed modular display wall inserts 210 (e.g., for re-creating an original appearance, in the case of damage). The replacement modular display wall inserts 210 may have different appearances or configurations (e.g., for reconfiguring a display wall 200). For example, a replacement modular display wall insert 210 may have the same outer shape as an installed modular display wall insert 210 (such that it is compatible with the receiving cavity 262 of the display wall frame 260) but a different inner configuration (see, e.g., FIGS. 6 and 7, showing many different potential configurations of modular display wall insert 210).

Display walls 200 may be large units, taller than many people (e.g., taller than 6 feet), and modular display wall inserts 210 may extend vertically nearly the full height of display wall 200 (save for the height attributable to the frame 260 above and below the display wall insert 210). Display wall 200 may include only a single row of modular display wall inserts (e.g., as shown in FIG. 6). Each modular display wall insert may extend vertically from a bottom frame portion to a top frame portion (e.g., as shown in FIGS. 6 and 7). Being so large, the ability to quickly and easily change the appearance of display walls 200 in place with minimal alteration can help save time, effort, and expertise.

As shown in FIGS. 6 and 7, many differently-configured modular display wall inserts 210 can be installed within receiving cavities 262 of display wall frames 260. In the case that a retailer wants to remove and replace one (e.g., as part of a store reconfiguration, or because one became damaged) the display wall 200 need not be removed or significantly altered. The old modular display wall insert 210 can simply be removed and replaced with another of the appropriate type to match the shape of the receiving cavity 262. Display wall inserts 210 can be installed within display wall frames 260 in a variety of ways, for example they can be screwed or bolted in against an underlying mounting structure 266 of display wall 200, they can be affixed within display wall framed 260 using magnets, or they can be installed using a cooperative connection of hooks or latches. In this way, a display wall 200 can be modularly reconfigured with minimal alteration and without the need for significant downtime or a specially-trained technician, facilitating easy creation and change of different retail environment configurations depending on the needs of the retailer. For example, U.S. patent application Nos. 29/656,127 (filed Jul. 10, 2018), 29/655,973 (filed Jul. 9, 2018), and 29/656,129 (filed Jul. 10, 2018) show examples of different configurations of display walls 200. Each of these applications is incorporated herein by reference thereto.

As mentioned above, inner side surfaces 264 of frame 260 may be formed of a removable panel (e.g., panel 268 shown in FIG. 7). The top removable panel 268 may have openings therethrough, for example, to accommodate internal lights that illuminate the display area of display wall 200. The removability of panels 268 can facilitate replacement, repair or maintenance of panels 268, which can allow reconfiguration or rehabilitation of display wall 200 in a modular manner, without having to disassemble frame 260. It can also facilitate access behind panels 268, for instance, to access bolts or other mounting fixtures behind the bottom panel 268, for mounting display wall 200 to the floor (as explained in more detail elsewhere herein) or to access lights behind the top panel 268 for maintenance or repair of the lights. FIG. 7 shows removable panel 268 on the bottom interior side of frame 260. A similar removable panel 268 may be similarly situated in the top interior side of frame 260.

To maintain the continuous seamless look of the inner side surface 264 of frame 260 (which, as mentioned above, may contrast in appearance with an exterior side of frame 260, and which may, for example, have a wood-grain look) removable panel 268 may not have any evident fastening means. Instead, it may be held in place by magnets. For example, there may be magnets attached to an interior side of removable panel 268 that align with magnets or magnetic material of frame 260. Frame 260 may also have a recess in its interior side to accommodate removable panel 268 and to help locate it in position. When display wall insert 210 is disposed within frame 260, it may overlap removable panel 268, thereby hiding a rear edge thereof and contributing to the continuous seamless appearance of the inner side surface 264.

To insert or remove removable panel 268, any display wall insert 210 may be removed, thereby exposing the rear edge of removable panel 268. Removable panel 268 may have a grasping feature 269, such as a ribbon or tab protruding from its rear edge that allows a user to pull removable panel 268 away from and out of frame 260.

Display walls 200 that are not positioned against a wall may have a first wall insert 210 and a second wall insert 210, each disposed on an opposing side of the display wall 200. The first and second wall inserts 210 may be recessed within cavity 262 of frame 260 thereby exposing inner side surface 264 of frame 260. Display walls 200 that are positioned against a wall may have only a single wall insert 210 disposed therein, on the side facing away from the wall.

Depending on the width of display wall 200, display wall 200 may be configured to receive one or more wall inserts 210. A small version may be configured to receive a single wall insert 210, whereas a larger version may be configured to receive two or more wall inserts 210 as both shown, for example, in FIG. 1. In some embodiments, the larger version may include inset wall inserts 210 on opposing sides (left and right), with graphic panel wall inserts 210 in between.

Figure 8:
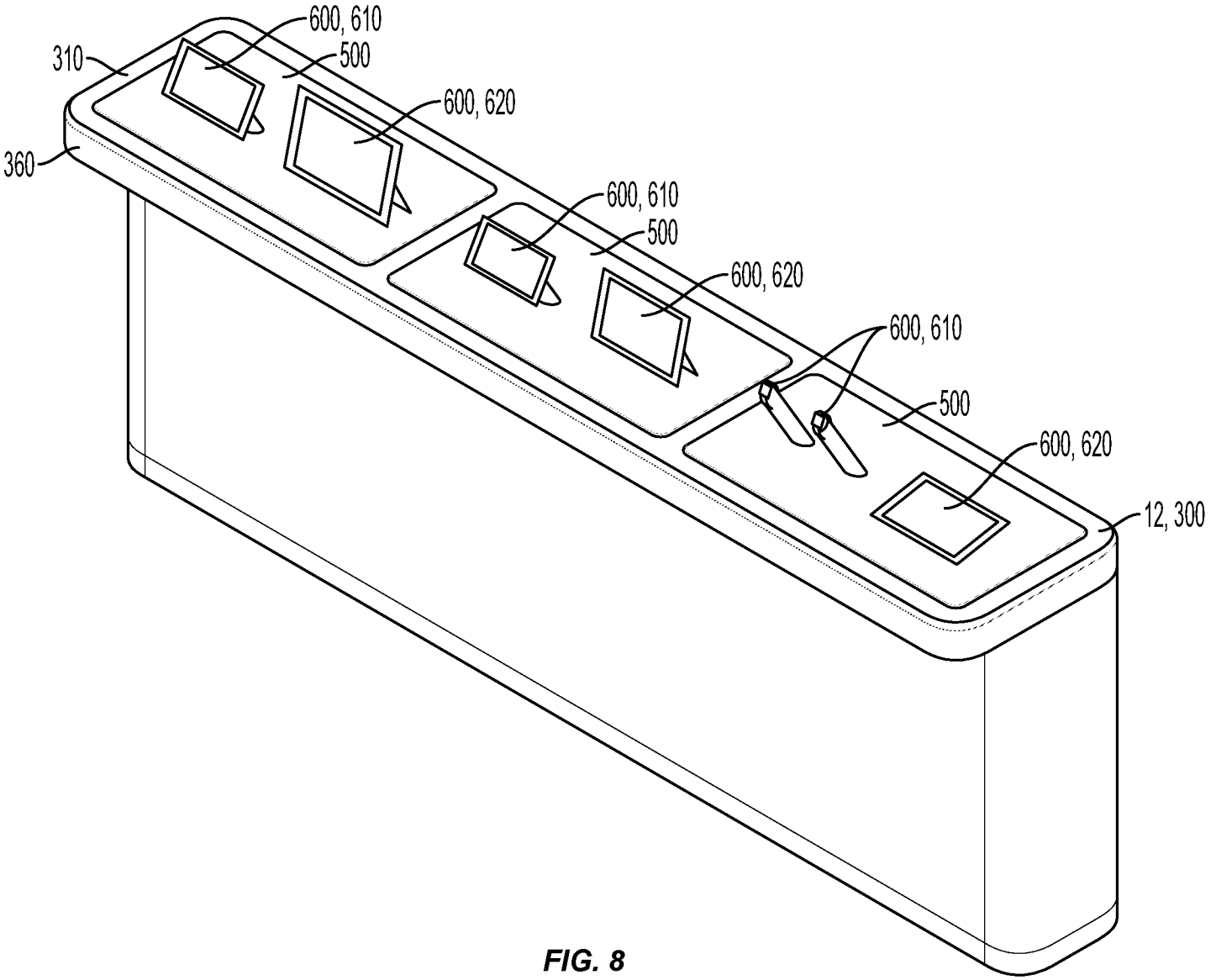
FIG. 8 shows a perspective view of a counter unit retail fixture.

FIG. 8 shows a retail counter unit 300, which is another type of modular retail fixture 12 that may be used to create a configurable retail environment as part of retail display system 10. Like table 100, counter unit 300 may have a continuous flat top surface, or it may be broken up into one or more display areas (e.g., three display areas are shown in FIG. 8), and the display areas are defined by modular mats 500 that appear to be situated on the top surface of counter unit 300. Retail counter unit 300 includes a counter top 310 and counter frame 360.

The description of the features and use of table top 110 and table frame 160 described above relative to retail display table 100 apply equally to counter top 310 and counter frame 360. Further, the description of the features and use of modular display mat 500 and lift tray 510 described in more detail above relative to retail display table 100 is equally applicable to retail counter unit 300. In fact, to increase the modularity and reconfigurability of retail display system 10 overall, all modular display mats 500 may be interchangeable with each other, including that modular display mats 500 of retail display tables 100, retail counter units 300, and display walls 200 may all be interchangeable with each other.

Figure 9:
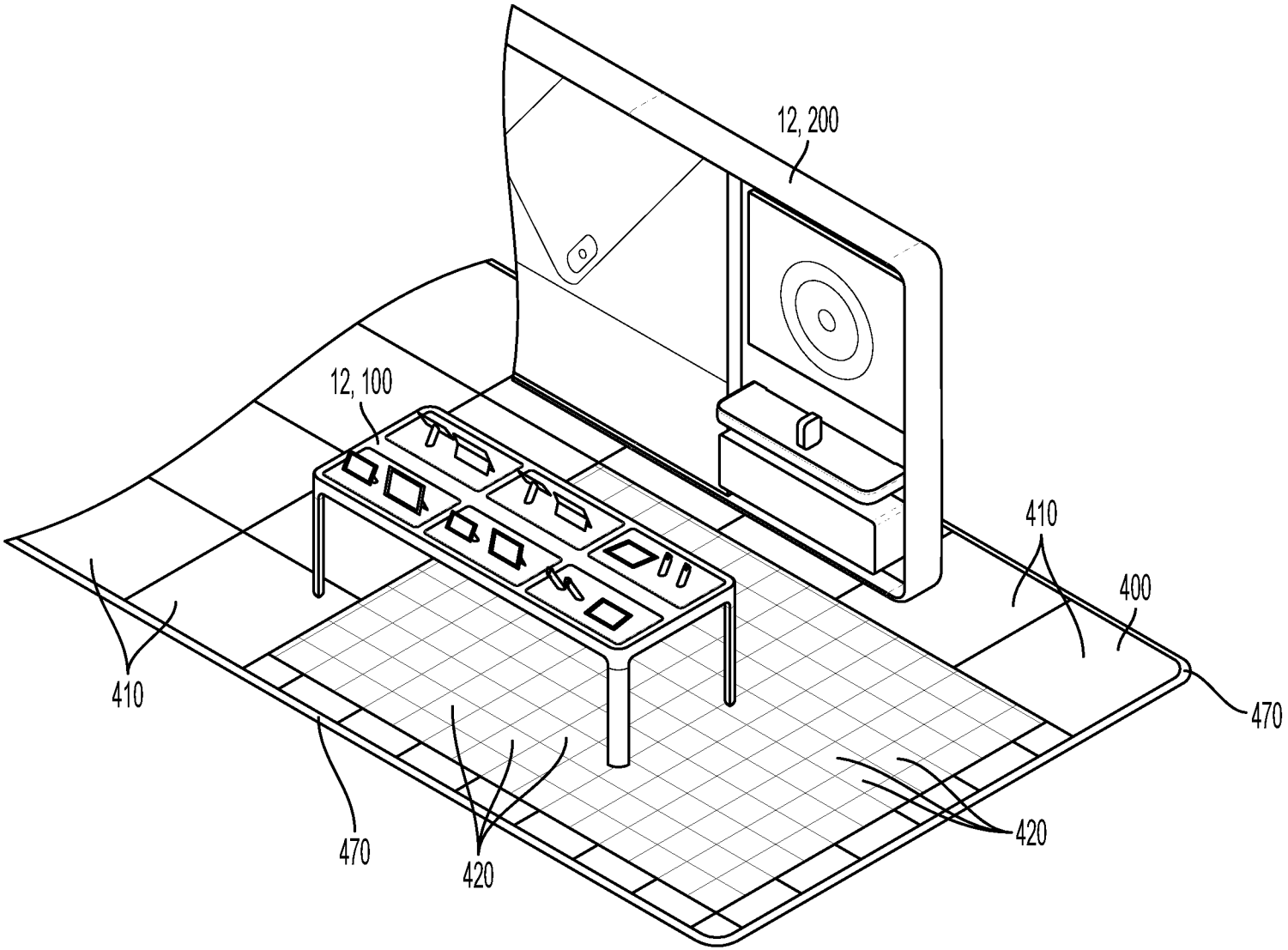
FIG. 9 shows a partial view of the retail display system of FIG. 1, with a portion of the floor broken away.
Figure 10:
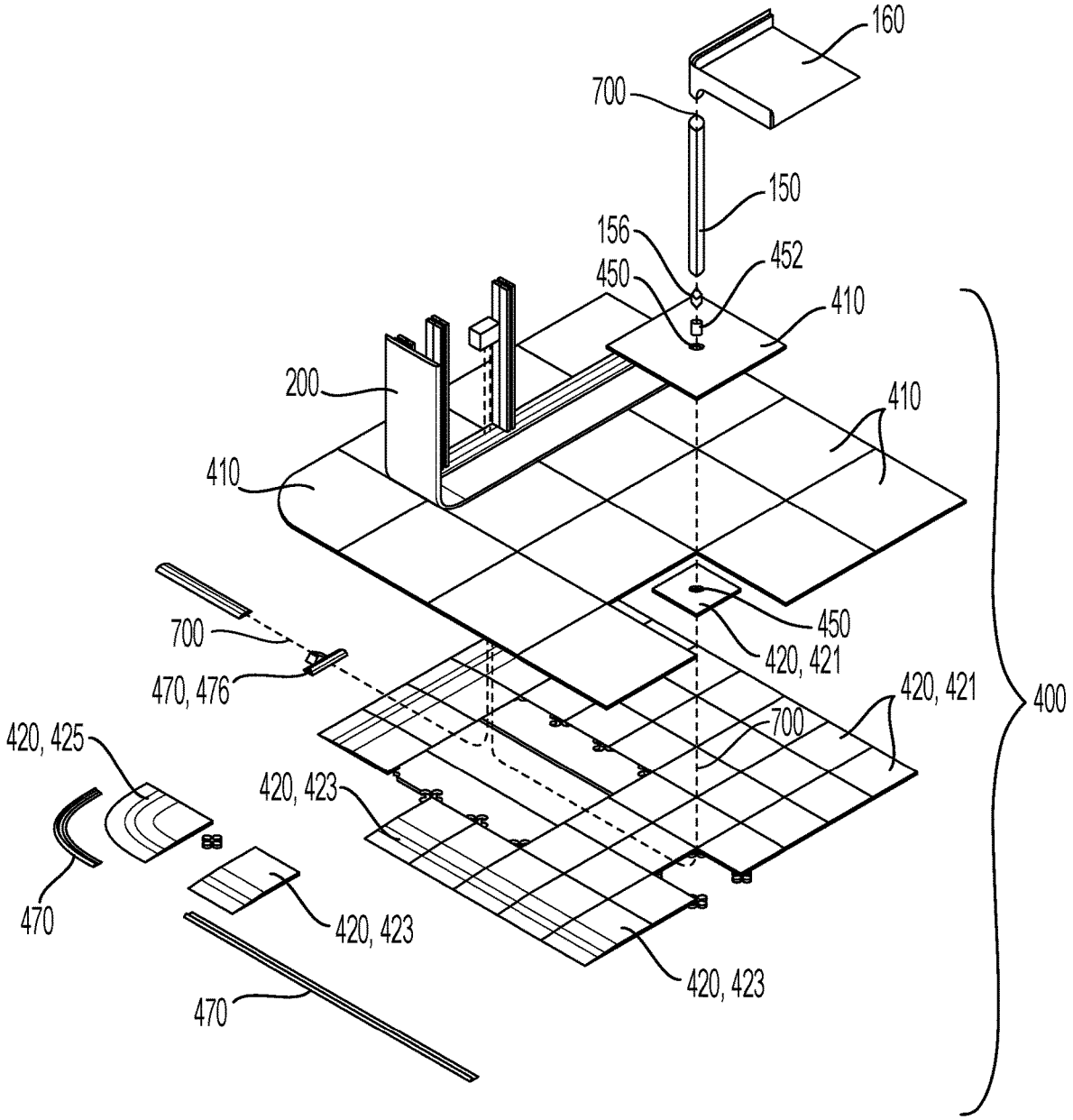
FIG. 10 shows a partial exploded view of a retail display system.
Figure 11:
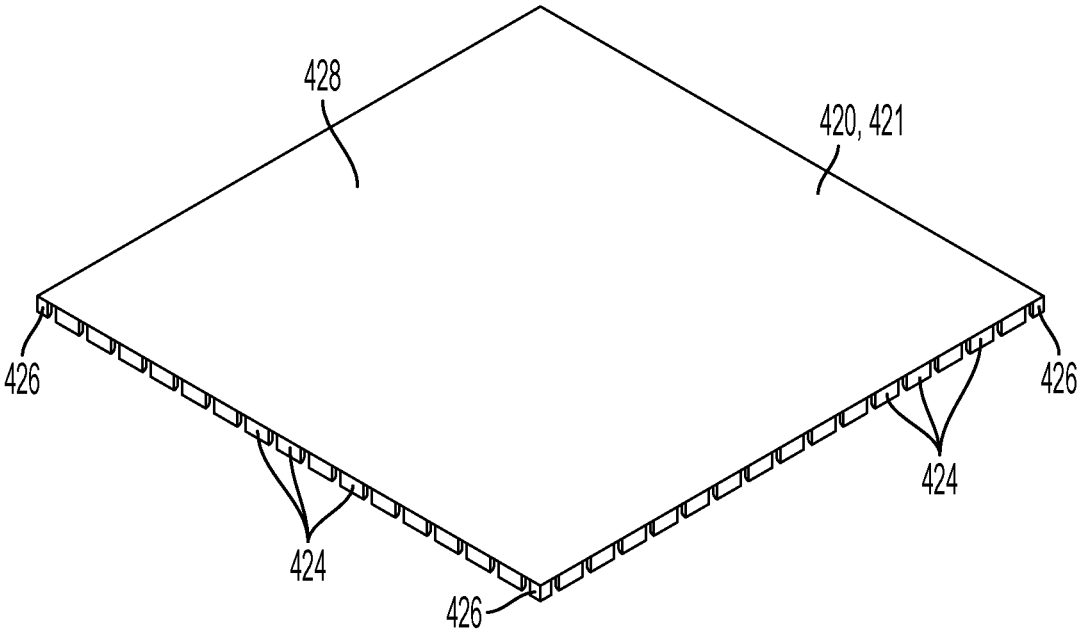
FIG. 11 shows a top perspective view of a subfloor tile of FIGS. 9 and 10.

FIGS. 9 and 10 illustrate portions of example store layouts showing underlying floor tiles and other components according to an embodiment of the invention. In FIG. 9, floor system 400 is shown with portions broken away to facilitate explanation. In FIG. 10, floor system 400 is shown as an exploded view for the same reason. The top surface of floor system 400 may be defined by carpet tiles 410. As shown, carpet tiles 410 are disposed atop subfloor tiles 420, which support carpet tiles 410 above an underlying floor. U.S. patent application Ser. No. 29/680,483 (filed Feb. 15, 2019) shows some example floor system components and is incorporated herein in its entirety by reference thereto.

Figure 12:
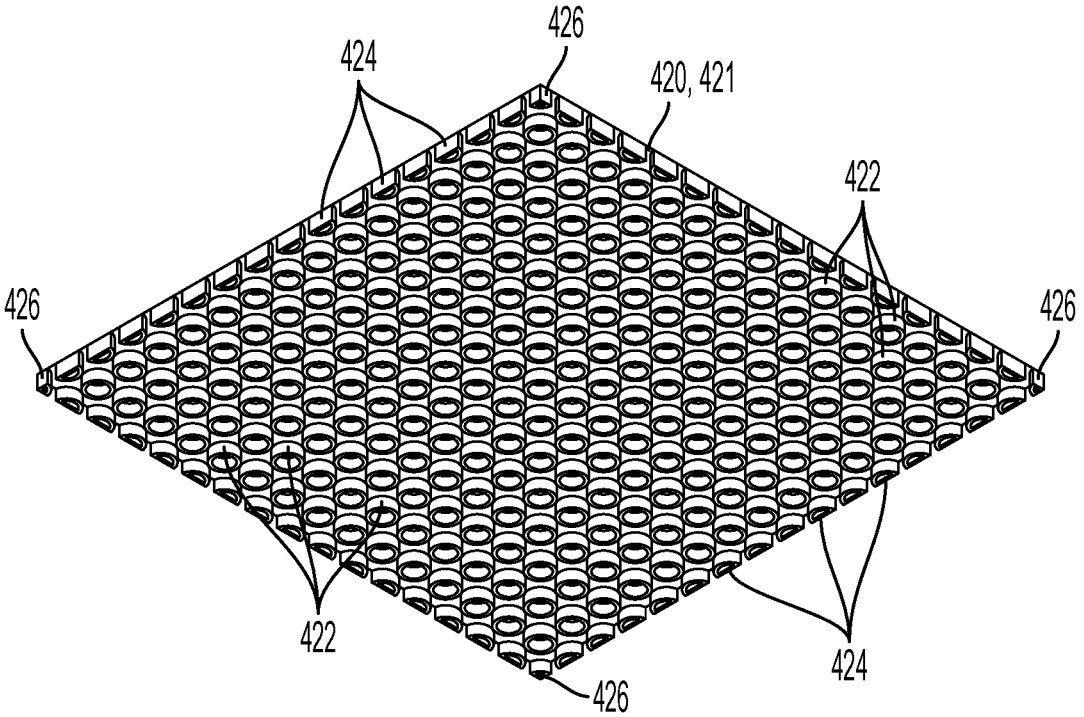
FIG. 12 shows a bottom perspective view of the subfloor tile of FIG. 11.
Figure 13:
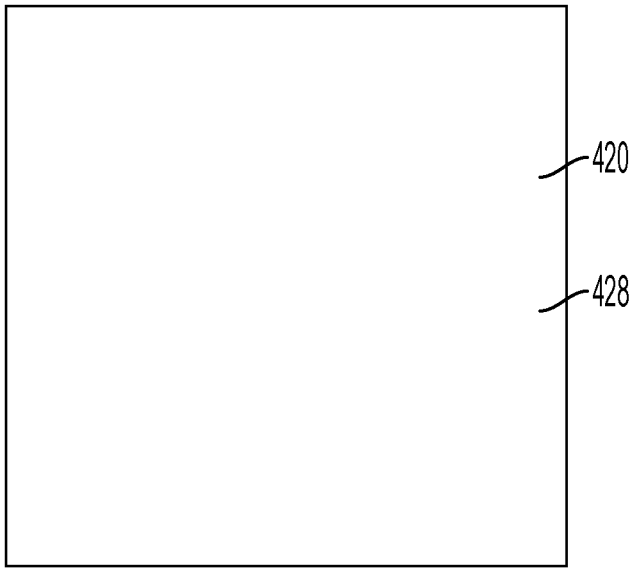
FIG. 13 shows a top view of the subfloor tile of FIG. 11.
Figure 14:
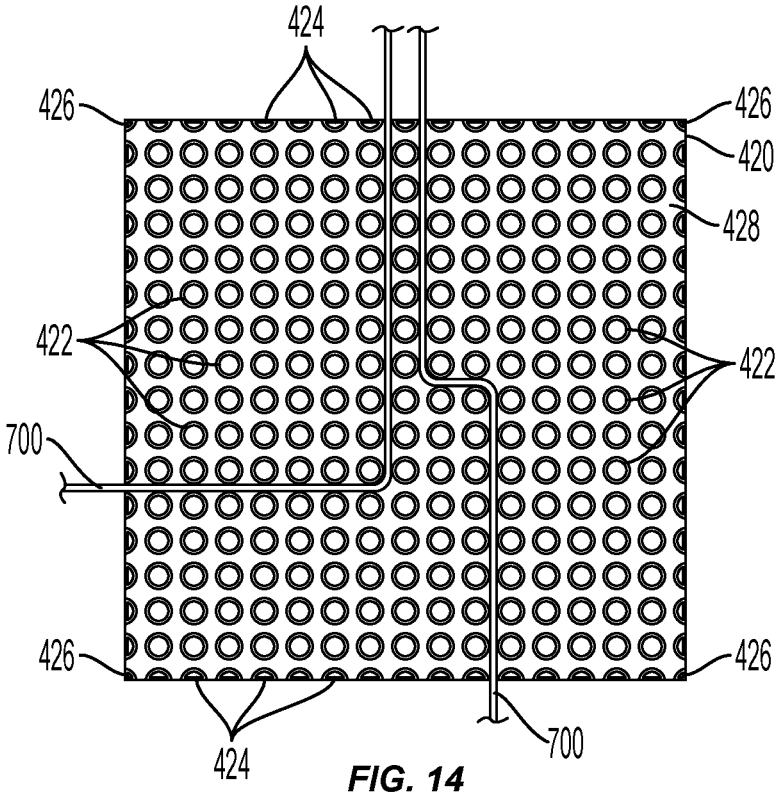
FIG. 14 shows a bottom view of the subfloor tile of FIG. 11.
Figure 15:
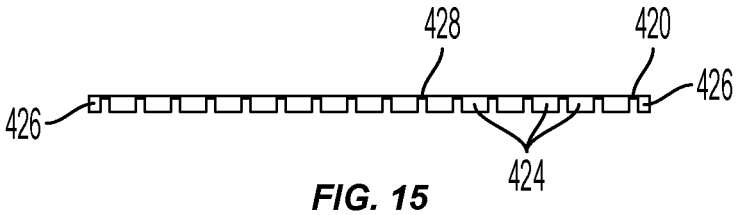
FIG. 15 shows a side view of the subfloor tile of FIG. 11.

Floor system 400 also includes edging segments 470 that connect to an outer periphery of carpet tiles 410 and subfloor tiles 420, and that together combine to define a continuous-looking outer periphery of floor system 400 (and also of a retail environment situated on floor system 400). Edging segments 470 may interconnect to outer edges of both subfloor tiles 420 and carpet tiles 410 to secure them in place relative to each other and to edging segments 470. This can help to keep floor system 400 together and unitary in use, and inhibits carpet tiles 410 from inadvertently lifting away from subfloor tiles 420 (see, e.g., FIG. 20, discussed in more detail below). Some edging segments 470, such as edging segment 476 in FIG. 10, can have openings to allow ingress and egress of wires underneath subfloor tiles 420, which can then be routed around circular supports 422 (see FIG. 12) of subfloor tiles 420 to get to and from components of retail display system 10 without being visible. For example, cable 700 may enter floor system 400 at edging segment 476, traverse beneath subfloor tiles 420 until arriving at a hole 450 extending up through subfloor tile 420 and an overlaying carpet tile 410. A leg 150 of a table 100 may be disposed over this hole, and cable 700 may be routed through this leg 150 into table 100 to provide power or data to table 100, as also explained elsewhere herein. Table leg 150 may be located over hole 450 by a positioning block 452 that connects to and within hole 450, and also through a table leg guide 156 that is fixed to an underside of table leg 150.

Floor system 400 may be rectangular in shape, with rounded corners. The rounded corners may be formed by a cooperating subfloor tile 420, carpet tile 410, and edging segment 470 that come together to form a unitary rounded corner, as shown in FIGS. 9 and 10, for example. The shapes of floor system 400 may be varied widely, however, to achieve different visual appearances and to accommodate differently sized and shaped retail environments. For example, rather than being rounded, corners of floor system 400 could have a squared or chamfered shape, among other shapes.

An example modular subfloor tile 420 is shown in more detail in FIGS. 11-15. As shown, each has an array of circular supports 422 in its interior, a series of closed half-circle-sector supports 424 along each of its outer edges, and a closed quarter-circle-sector support 426 at each corner. Each support 422, 424, 426 may be hollow, as shown. Circular supports 422, closed half-circle-sector supports 424, and closed quarter-circle-sector supports 426 may all have the same radius (as to their circular sector portions) such that when aligned next to similar supports in other subfloor tiles, closed half-circle-sector supports 424 and a closed quarter-circle-sector supports 426 (together with the aligned similar supports) form circles having the same diameter as circular supports 422.

Supports 422, 424, 426 support an upper panel 428 of subfloor tile 420 above the ground (i.e., above the underlying floor surface). Upper panel 428 defines a flat upper surface (e.g., on which carpet tiles 410 can be installed, affixed, for example, with double-sided tape). Supports 422, 424, 426 are tall enough and spaced apart far enough to accommodate a standard-diameter power cable between adjacent supports 422, 424, 426, and are sized and shaped so as to have a rounded radius against which such cable can gently turn without overtaxing the cable's structural flexibility, such as cable 700 shown in FIG. 14, for example. For example, supports 422, 424, 426 may be at least ¾ inches tall and spaced apart by at least ¾ inches. In this way, a power and/or data cable 700 can deliver power and/or establish a data connection unseen within floor system 400 to any modular retail fixture 12 of retail display system 10. Such modular retail fixture 12—for example retail display table 100 may in turn deliver this power and/or data connection to its displayed items 600 through, for example, power and/or data connection 140 (see FIG. 4). This helps keep the overlying retail environment neat and clear of any visual indication of cabling, while still allowing power and data connections to reach the retail display fixtures 12 situated on floor system 400.

Figure 16:
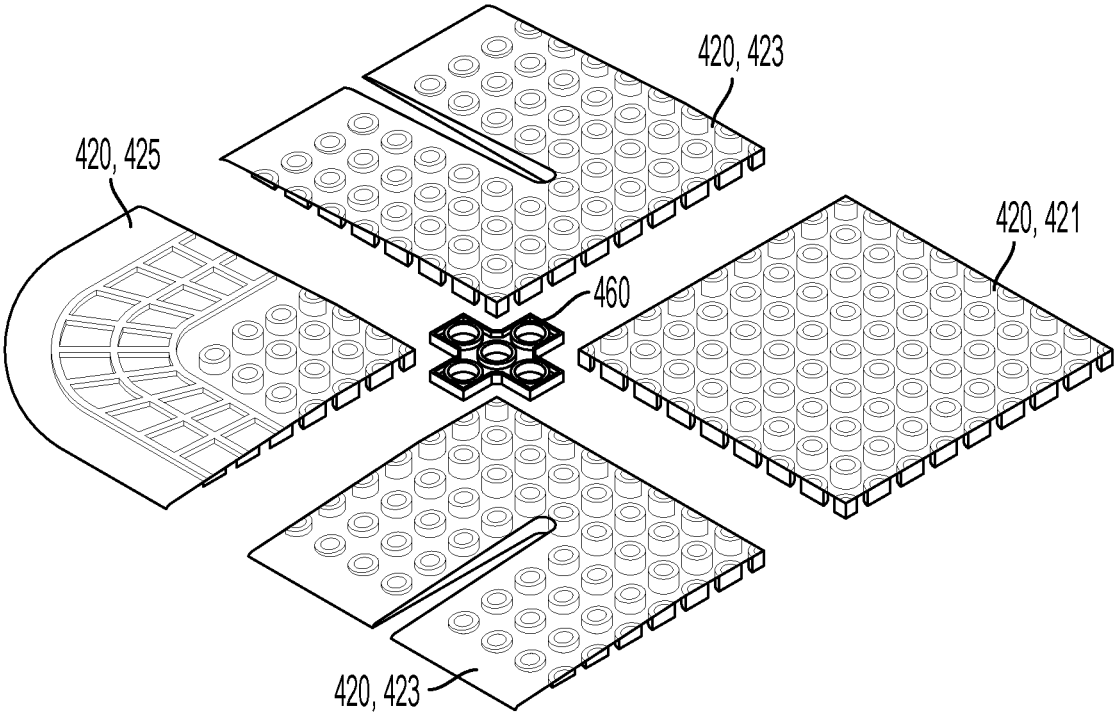
FIG. 16 shows an exploded perspective view of subfloor tiles of FIGS. 9 and 10, shown partially transparent.
Figure 17:
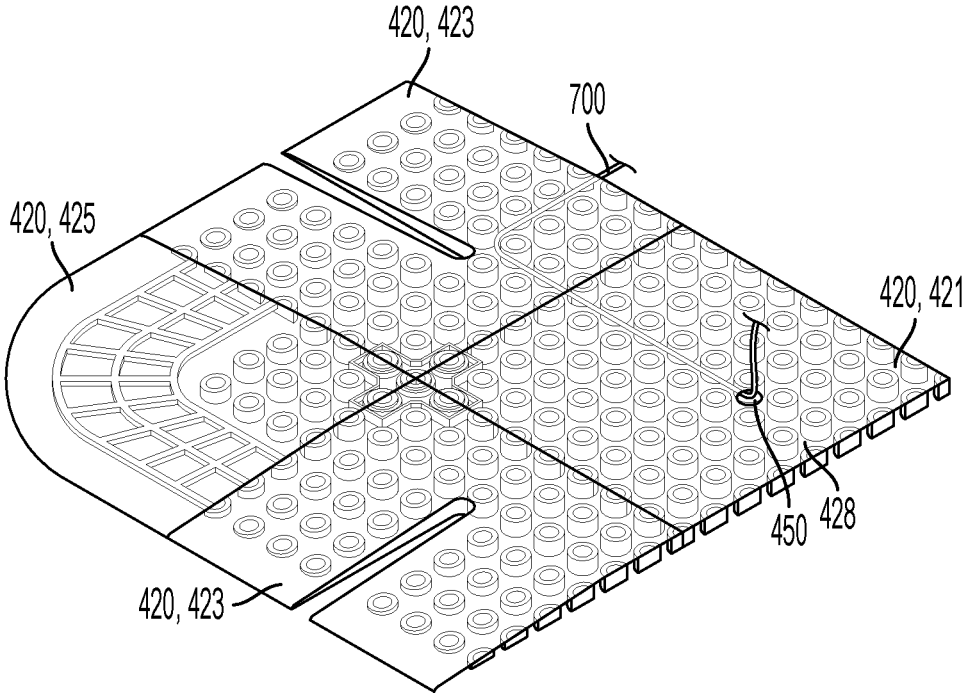
FIG. 17 shows a top perspective assembled view of the assembled subfloor tiles of FIG. 16.

Outer subfloor tiles 420 may taper downwards, to transition to a surrounding floor upon which floor system 400 is disposed. This can make it easier for customers, mobility devices, and carts to move into and out of the defined retail environment of retail display system 10. FIGS. 16-20 show inner subfloor tile 421 along with transition subfloor tiles 423 and 425. Transition subfloor tiles 423 provide a tapered outer edge to provide a ramped transition up to the level of inner subfloor tile 421. Transition floor tile 425 provides a tapered outer corner and outer edges to provide a ramped transition up to the level of inner subfloor tile 421. In FIGS. 16 and 17, subfloor tiles 421, 423, 425 are shown transparent so that their underlying features can be seen for ease of explanation. As can be seen, transition subfloor tiles 423 and 425 include circular supports 422, closed half-circle-sector supports 424, and closed quarter-circle-sector supports 426 as described above for subfloor tile 421.

Figure 18:
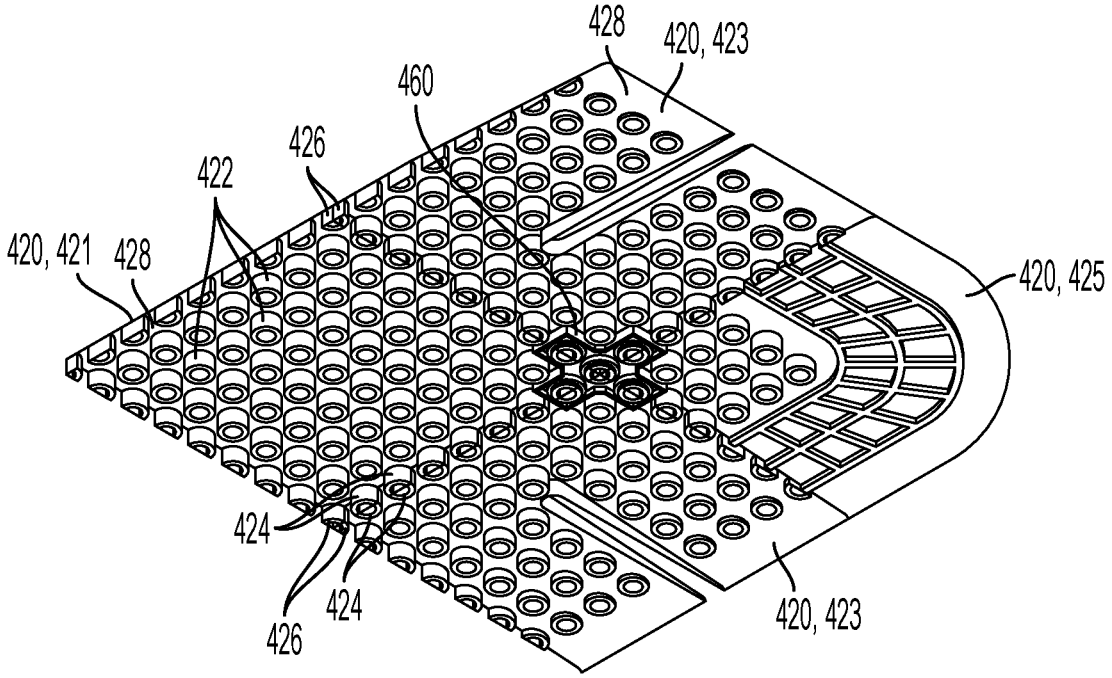
FIG. 18 shows a bottom perspective assembled view of the assembled subfloor tiles of FIG. 16.

Also shown in FIGS. 16-18 is a tile connector 460. Tile connector 460 is cross-shaped, with five circular holes extending through it. Each circular hole has the same diameter as, or slightly larger diameter than, an outer diameter of circular supports 422. When subfloor tiles 421, 423, 425 are aligned next to each other to form a subfloor, as shown in FIG. 17, tile connector 460 can fit over aligned closed half-circle-sector supports 424 and closed quarter-circle-sector supports 426 to hold subfloor tiles 421, 423, 425 in place next to each other. Because circular supports 422, closed half-circle-sector supports 424, and closed quarter-circle-sector supports 426 when aligned form an array of uniformly sized and spaced supports, tile connector 460 can be inserted over such supports in any place where a connection between subfloor tiles is desired.

FIG. 17 also shows cable 700 extending underneath subfloor tiles 421, 423 and coming out a hole 450 through upper panel 428 of subfloor tile 421. In use, hole 450 may be positioned directly underneath a table leg 150 of a retail display table 100, as shown in FIG. 10, and cable 700 may extend within and through table leg 150 (see FIG. 5) to deliver power and/or data to retail display table 100 (e.g., as described above).

Figure 19A:
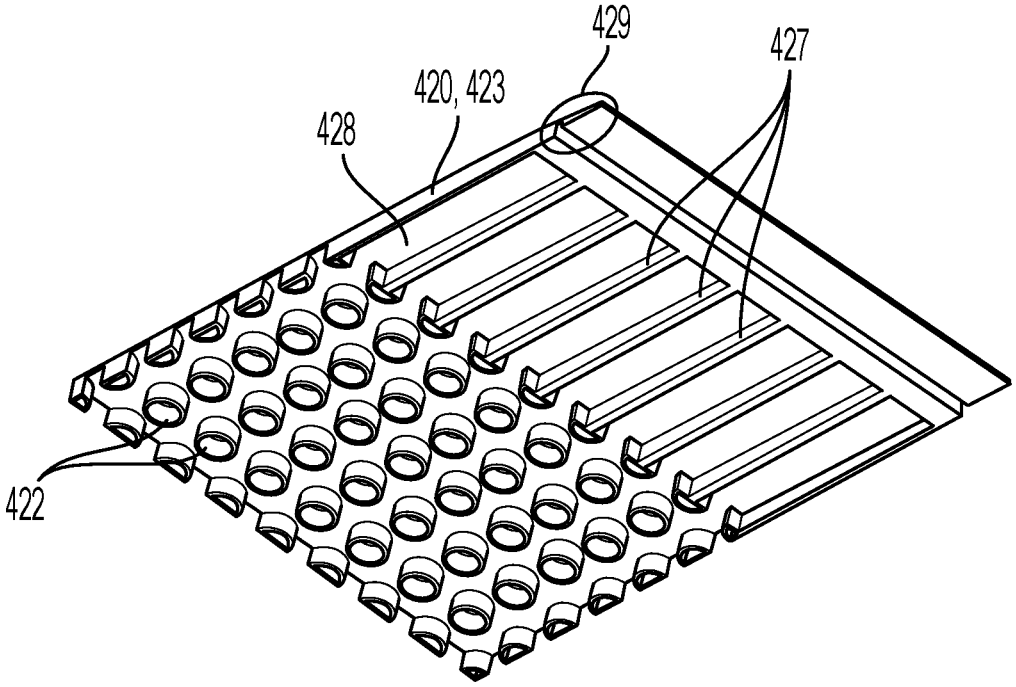
FIGS. 19A and 19B each show a bottom perspective view of a subfloor tile of FIGS. 9 and 10.
Figure 19B:
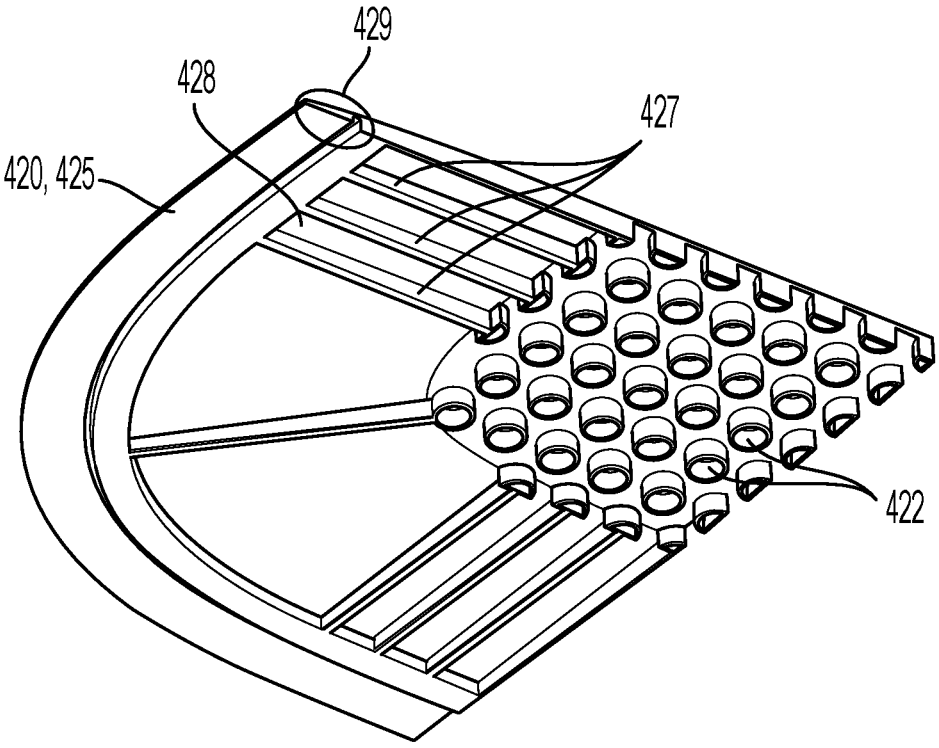

FIGS. 19A and 19B show the underside of subfloor tiles 423 and 425, which are transition subfloor tiles 420. As shown, in addition to circular supports 422, some subfloor tiles 420 may include other support structures such as, for example, support ribs 427. Support ribs 427 can be used in conjunction with circular supports 422 to provide support to subfloor tiles 420, and, in the case of transition subfloor tiles 420 (like subfloor tiles 423 and 425 shown), support ribs 427 can support a tapering portion of subfloor tile 420 to help upper panel 428 of subfloor tile 420 taper downward toward an outer edge of floor system 400.

Figure 20:
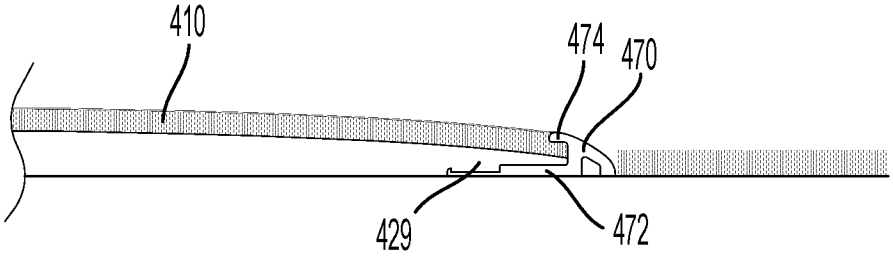
FIG. 20 shows a side view of a portion of a floor system including the subfloor tile of FIG. 19.

Also, the outer portions of transition subfloor tiles 423, 425 may have an interlocking structure 429. As shown in the side view of FIG. 20, this interlocking structure 429 may have a cooperating shape with interlocking structure 472 of edging segments 470. Thus, edging segment 470 can extend under and be mechanically captured in place by the interlocking structure 429 of the overlying portion of transition subfloor tile 423,425. FIG. 20 also shows an overlying carpet tile 410, an outer edge of which gets captured beneath an overlying hook structure 474 of edging segment 470. Overlying hook structure 474 extends inward toward the interior of floor system 400, vertically spaced apart from interlocking structure 472. This defines a space between interlocking structure 472 and overlying hook structure 474, within which an outer edge of carpet tile 410 is captured. Thus, outer edges of subfloor tile 420 and carpet tile 410 are interconnected together with edging segment 470 by their own structures, without any additional interconnecting components.

Figure 21:
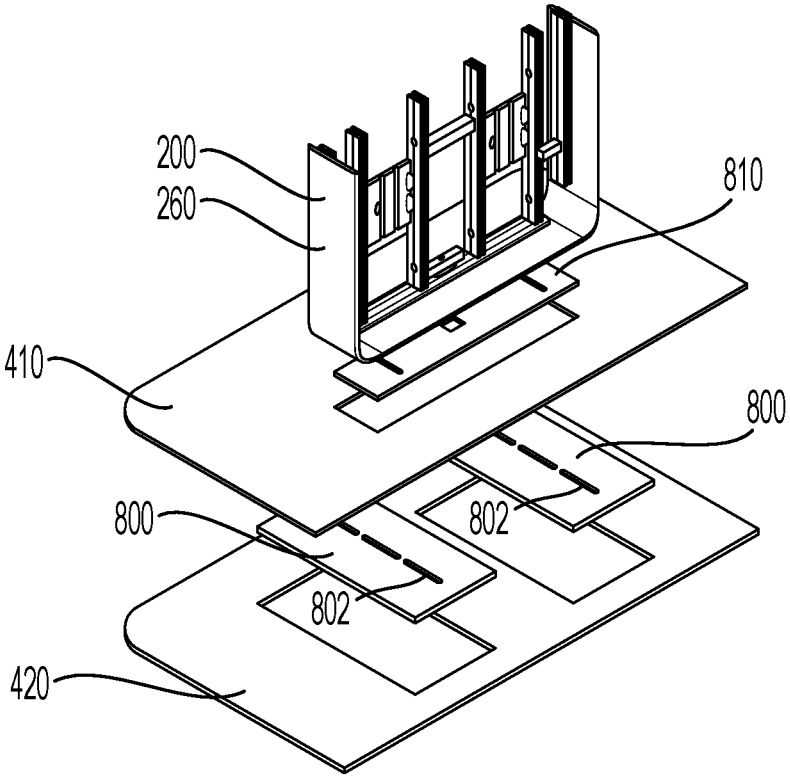
FIG. 21 shows a partial exploded view of a retail display system.
Figure 22:
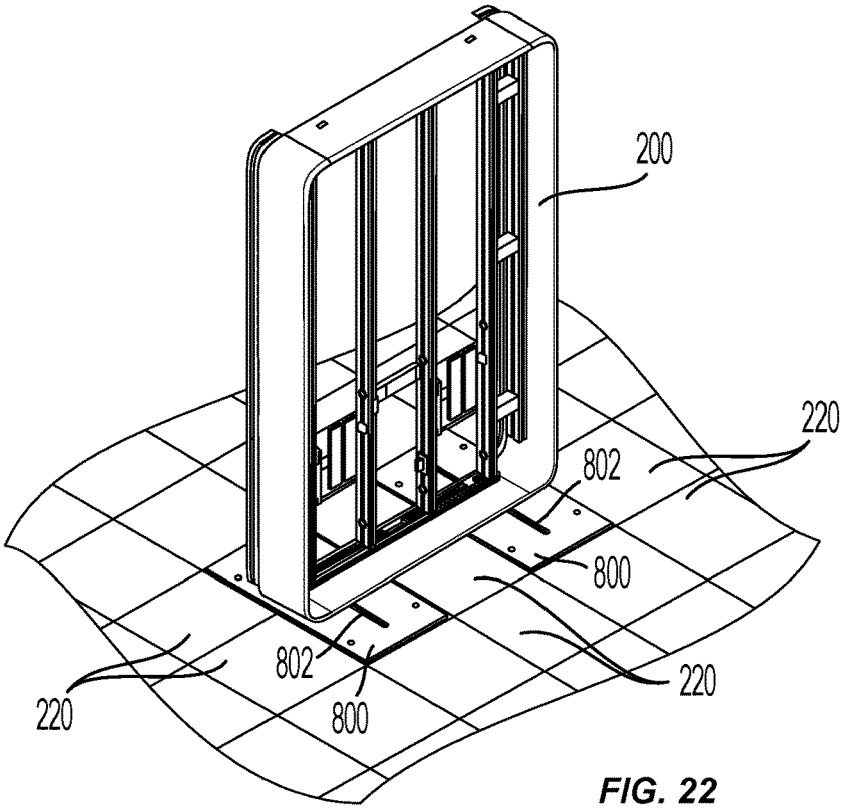
FIG. 22 shows a partial view of the retail display system of FIG. 21.
Figure 23:
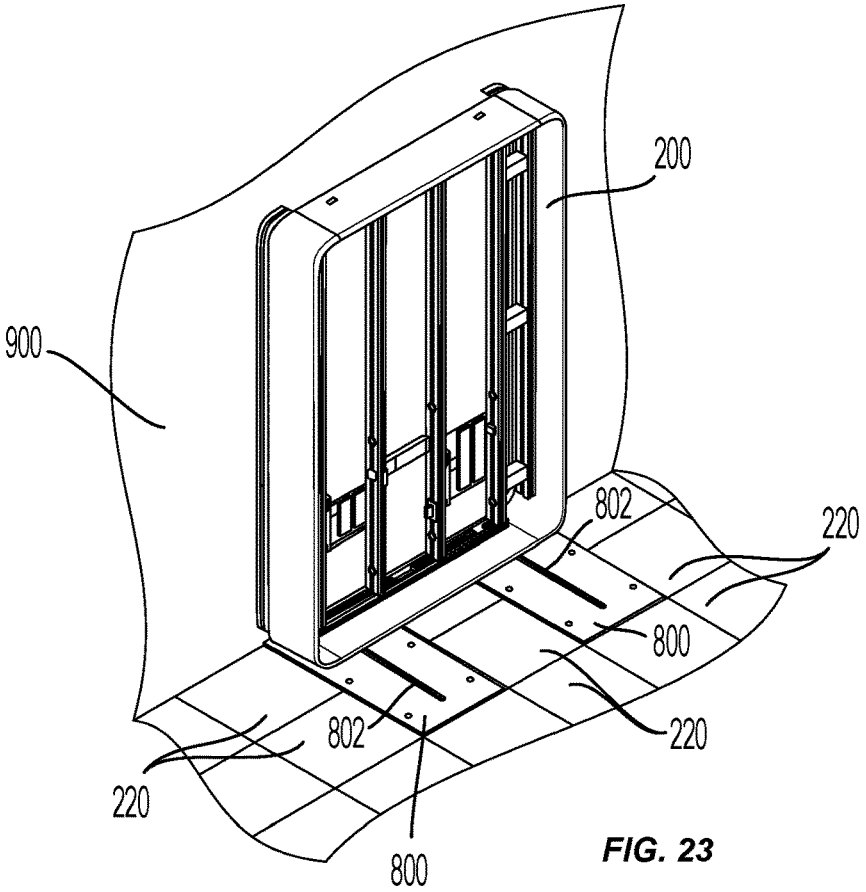
FIG. 23 shows a partial view of another configuration of the retail display system of FIG. 22.
Figure 24:
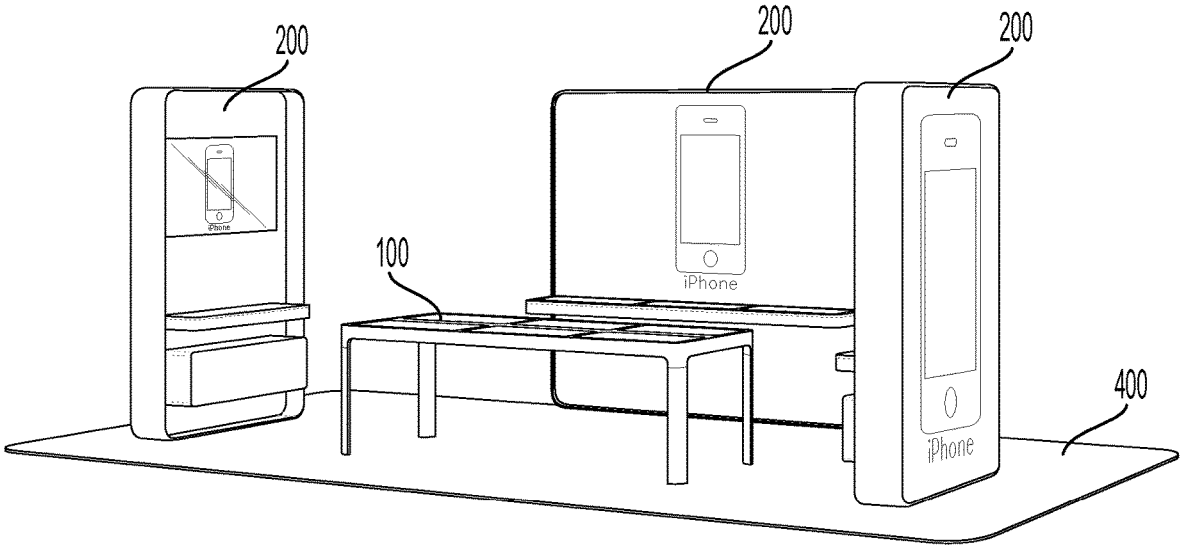
FIG. 24 shows a perspective view of an example configuration of a retail display system.
Figure 25:
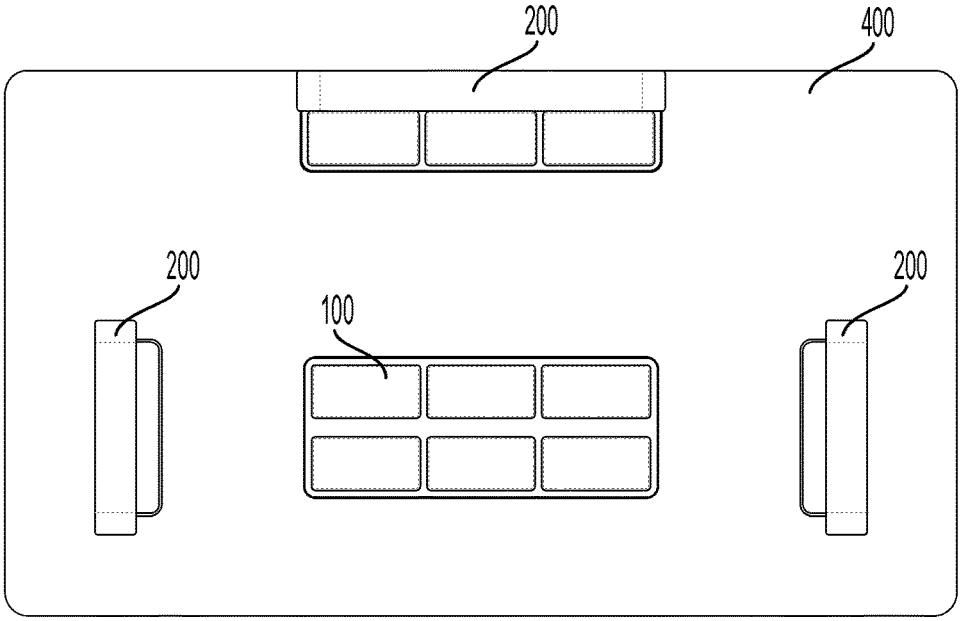
FIG. 25 shows a top view of the configuration of FIG. 24.
Figure 26:
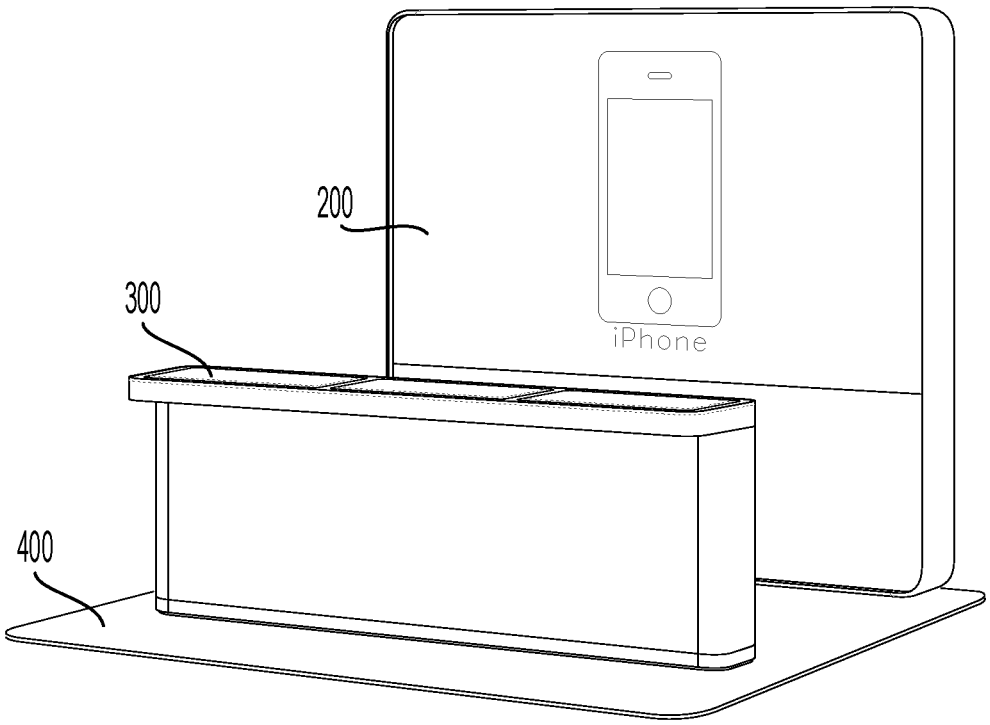
FIG. 26 shows a perspective view of an example configuration of a retail display system.
Figure 27:
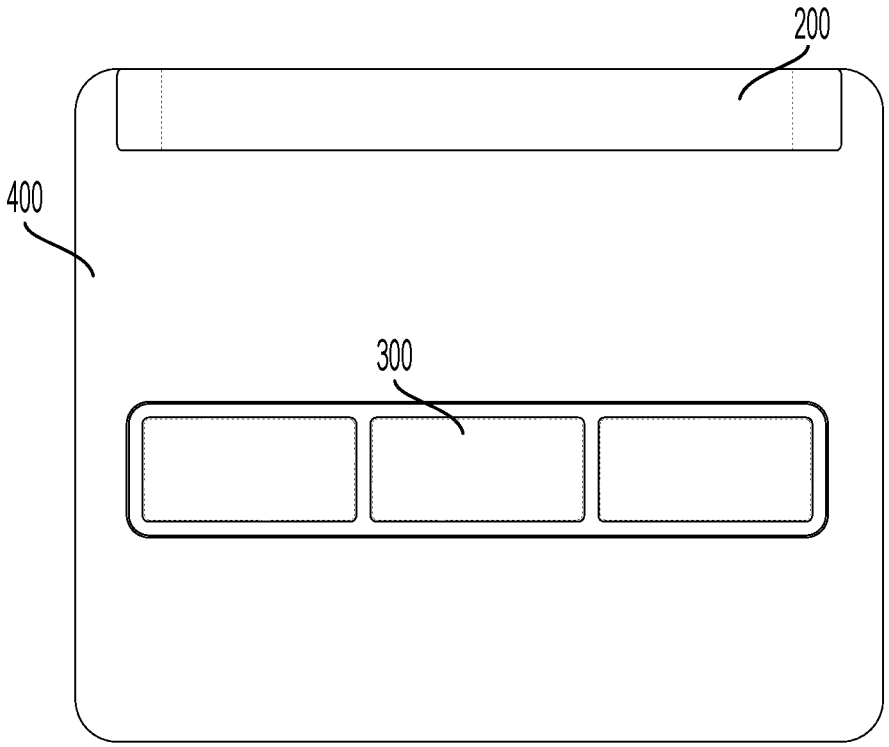
FIG. 27 shows a top view of the configuration of FIG. 26.
Figure 28:
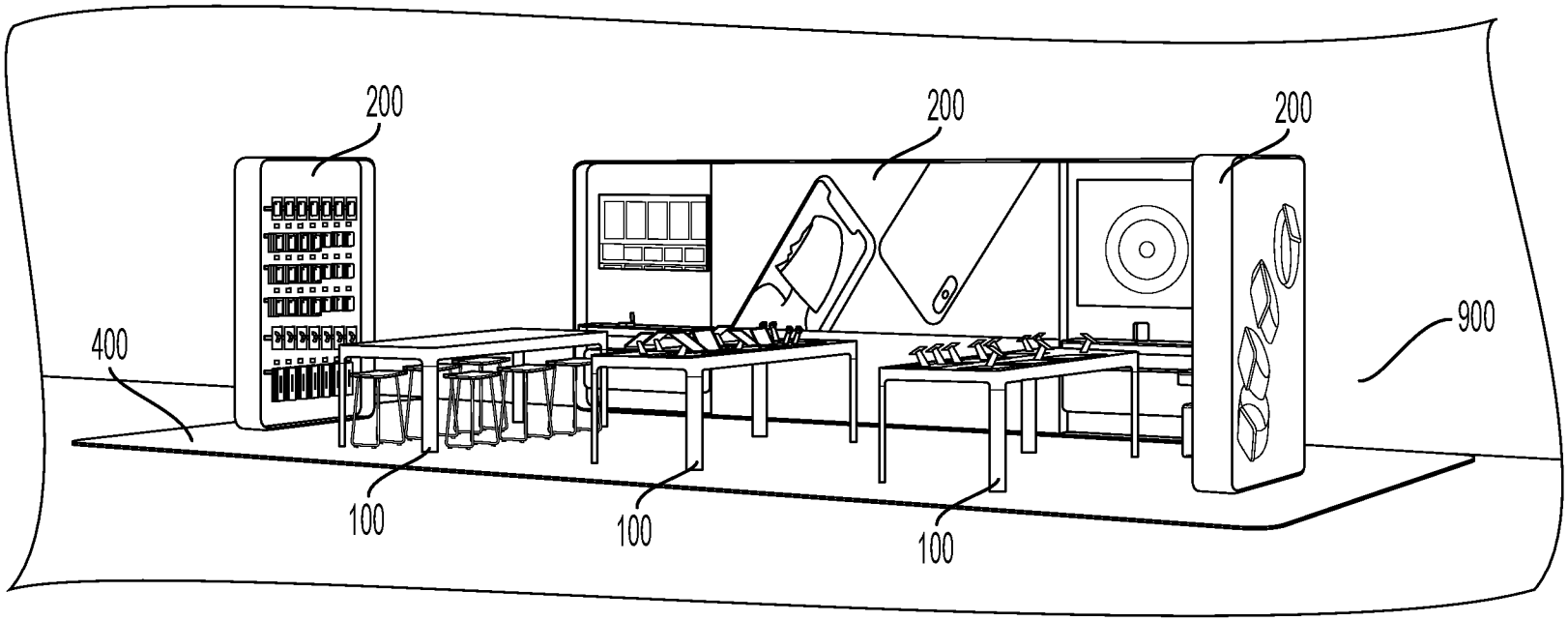
FIG. 28 shows a perspective view of an example configuration of a retail display system.
Figure 29:
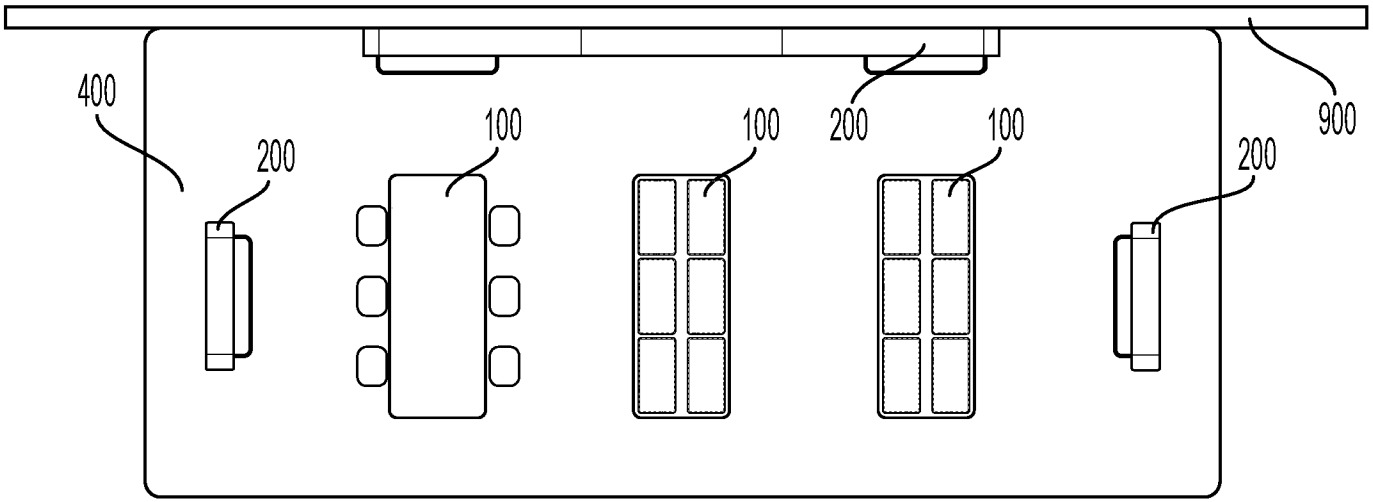
FIG. 29 shows a top view of the configuration of FIG. 28.
Figure 30:
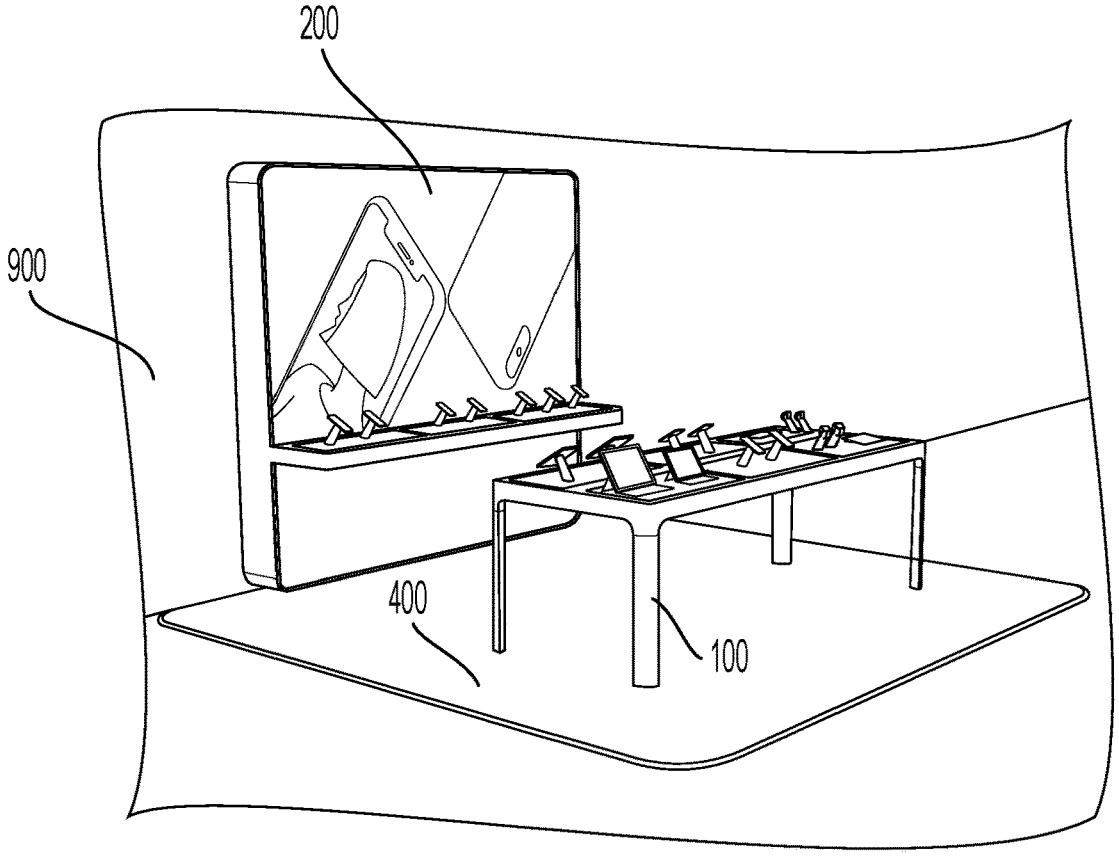
FIG. 30 shows a perspective view of an example configuration of a retail display system.
Figure 31:
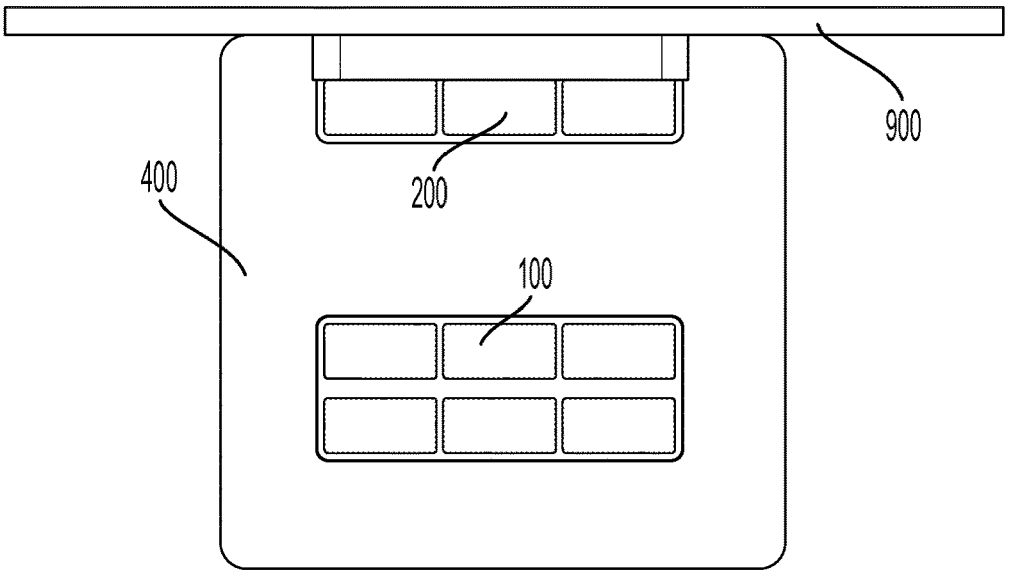
FIG. 31 shows a top view of the configuration of FIG. 30.
Figure 32:
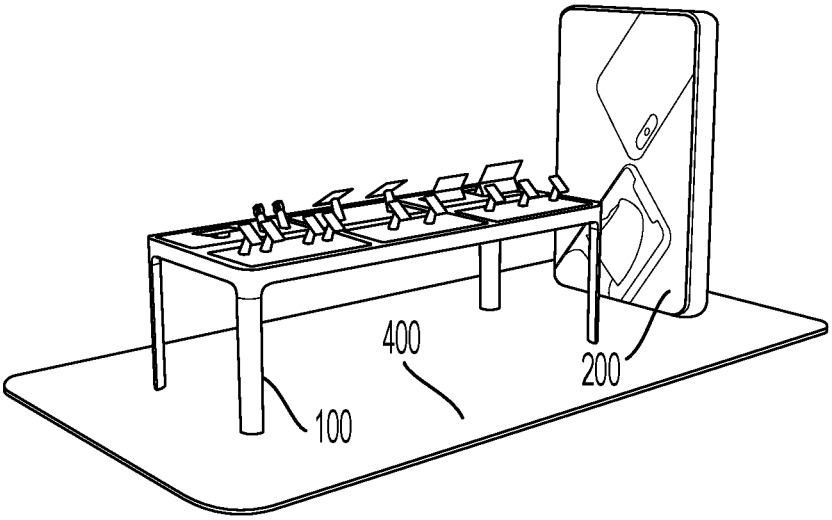
FIG. 32 shows a perspective view of an example configuration of a retail display system.
Figure 33:
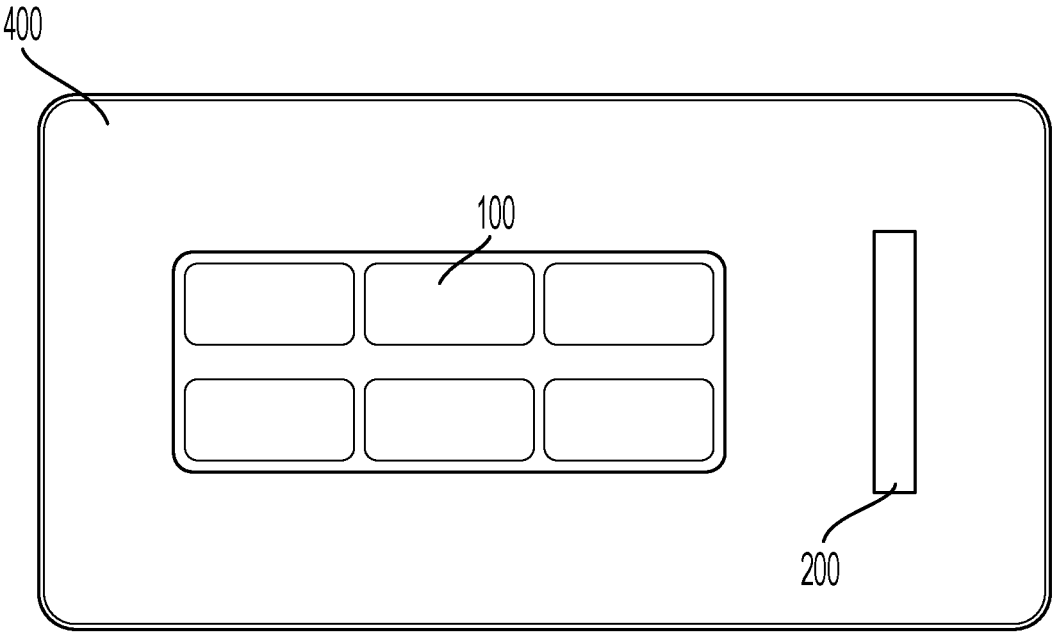
FIG. 33 shows a top view of the configuration of FIG. 32.

FIGS. 21-23 show support structure for a display wall 200. As shown, a display wall 200 may be connected at a bottom section of its frame 260 to support plates 800. Display wall 200 may extend above carpet tiles 410 in a first direction. Support plates 800 may extend under carpet tiles 410 in a second direction perpendicular to the first direction. In other words, support plates 800 may extend in front of and behind a display wall 200 in a front-to-back direction relative to display wall 200, to increase the stability of display wall 200 in a front-to-back direction. Support plates 800 may be bolted to display wall 200 along a bottom horizontal section of frame 260. In some embodiments, an intermediate pedestal plate 810 is disposed between display wall 200 and support plates 800 to strengthen the connection between display wall 200 and support plates 800. To help secure display wall 200 in place, support plates 800 may be bolted into the floor that underlies floor system 400.

To seamlessly integrate into floor system 400, each support plates 800 may be sized to take the place of adjacent subfloor tiles 420. For example, as shown in FIGS. 21-23, each support plate 800 is sized to take the place of two adjacent subfloor tiles 420. In this way, each support plate 800 may fit into and fill a cavity between surrounding subfloor tiles 420. In other words, each support plate 800 may have a width that is an integer multiple of a width of a subfloor tile 420, and a length that is an integer multiple of a subfloor tile 420. Each support plate 800 may also have the same depth as an inner subfloor tile 421, such that when it is disposed between surrounding subfloor tiles 420, carpet tiles 410 may overlay both the support plate 800 and the surrounding subfloor tiles 420 with no noticeable difference from above carpet tiles 410. To help give the appearance that display wall 200 is resting on floor system 400, without the appearance of additional support features, carpet tiles 410 may extend under portions of frame 260 of display wall 200 all around the bottom of display wall 200. For example, carpet tiles 410 may extend underneath the rounded bottom corners of display wall 200. In this way, the structure that connects support wall 200 to support plates 800 between carpet tiles 410 is not visually apparent.

To further increase the modularity of retail display system 10, support plates 800 may have slots 802 therethrough extending centrally along their length. This helps to facilitate flexibility in positioning within a retail environment. For example, in the case where display wall 200 is positioned away from a wall (as shown in FIGS. 21 and 22), it is positioned centrally on support plates 800, and bolts securing display wall 200 to support plate 800 go through slots 802 centrally along slots 802. But in the case where display wall 200 is positioned against a wall 900 (as shown in FIG. 23), it can be positioned at or near ends of support plates 800, and bolts securing display wall 200 to support plates 800 go through slots 802 at or near an end of slots 802. In the case where display wall 200 is positioned against a wall 900, display wall 200 may also be anchored to wall 900 (e.g., by bolts or other connection hardware). In either case the support plates 800 can be optionally secured to the underlying floor, e.g., by bolts through support plates 800 and into the floor. Thus the slotted configuration of support plates 800 allows them to be used in multiple configurations, contributing to the flexibility and modularity of retail display system 10.

Display wall 200 is shown in FIGS. 21-23 with two support plates 800. In some embodiments display wall 200 is supported by more than two support plates 800. For example, longer versions of display wall 200 may include 3-6 support plates, or even more depending on the parameters of the display wall and its installation environment.

Support plates 800 are shown supporting a display wall 200. In some embodiments support plates 800 are used to support other retail display fixtures 12, such as, for example, counter units 300.

As described above, retail display system 10 allows for a high degree of modularity at many different levels, including the modular display fixtures themselves (e.g., tables 100, display walls 200, counter units 300) as well as their components (e.g., modular display mats 500, table tops 110, counter tops 310, modular display wall inserts 210, and modular counter panels 212) and displayed items 600. Some other example configurations are shown in FIGS. 24-33. Not only does this modularity make reconfigurations easier and less expensive as described above, but it also extends the useful life of many components of the retail display system 10. For example, a table frame 160 or a display wall frame 260 can be re-used in place to support all kinds of reconfigurations, using the components and techniques described above. Some examples are shown in U.S. patent application Ser. Nos. 29/658,466 (filed Jul. 31, 2018), 29/655,963 (filed Jul. 9, 2018), 29/655,967 (filed Jul. 9, 2018), 29/656,127 (filed Jul. 10, 2018), 29/655,973 (filed Jul. 9, 2018), and 29/656,129 (filed Jul. 10, 2018). Each of these applications is incorporated herein by reference thereto.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A retail display table, comprising:

a frame;

a table top disposed within and supported by the frame, wherein the table top has openings therethrough; and a modular display mat disposed over each opening, wherein each of the modular display mats is movable between a closed position in which it covers its respective table-top opening, and an open position in which it is lifted above the table top so that a cavity underneath the modular display mat is accessible, and wherein each modular display mat has a configuration of holes therethrough to accommodate a configuration of displayed items, and is removable and replaceable with another modular display mat having a different configuration of holes to accommodate a different configuration of displayed items.

2. The retail display table of claim 1, further comprising a lift tray disposed in each of the table-top openings, wherein each of the modular display mats is coupled to one of the lift trays, and wherein each lift tray lifts and lowers its respective modular display mat to move the modular display mat between the open and closed positions.

3. The retail display table of claim 1, wherein at least one of the displayed items comprises a cable that extends through the hole in its respective modular display mat, wherein the cable is hidden when the display mat is in the closed position, and wherein the cable is accessible when the display mat is in the open position.

4. The retail display table of claim 1, wherein the table top is flat and finished on both a top side surface and a bottom side surface, and wherein the table top is reversible relative to the frame so that the top side surface can become the bottom side surface and the bottom side surface can become the top side surface.

5. The retail display table of claim 4, wherein, in an undamaged state, the bottom side surface of the table top has the same appearance as the top side surface of the table top.

6. The retail display table of claim 1, further comprising table legs connected to and supporting the frame, wherein each of the table legs has an inward-facing surface that faces an area under the table top, and an outward-facing surface that faces outward from the retail display table, and wherein each of the table legs is reversible relative to the frame so that its outward-facing surface can become an inward-facing surface, and its inward-facing surface can become an outward-facing surface.

7. The retail display table of claim 6, wherein, in an undamaged state, the outward-facing surfaces have the same appearance as the inward-facing surfaces.

8. The retail display table of claim 1, further comprising table legs connected to and supporting the frame, wherein an external surface of each table leg at a horizontal cross-section therethrough defines a shape with an order of rotational symmetry of 2.

9. A table, comprising:

a table top having rectangular openings therethrough;

modular mats, wherein one modular mat covers each opening, and wherein each modular mat has a hole therethrough; and fixtures coupled to each modular display mat, wherein one fixture covers each hole, wherein each of the modular mats is interchangeable with another of the modular mats, and is removable and replaceable with a different modular mat.

10. The table of claim 9, wherein the table top is flat and finished on both a top side and a bottom side, and wherein the table top is reversible relative to a frame so that the top side can become the bottom side and the bottom side can become the top side.

11. The table of claim 9, wherein the table top further has a second opening therethrough, in addition to the first openings, wherein the table further comprises a non-mat modular element disposed within the second opening, and wherein the non-mat modular element is swappable with each of the modular mats so that the non-mat modular element is disposed within one of the first openings and one of the modular mats is disposed within the second opening.

12. The table of claim 11, wherein the non-mat modular element is a recessed display cavity covered with a transparent cover.

13. A retail display system comprising:

a table, the table comprising:

a table frame;

a table top disposed within the frame and having openings therethrough;

modular display mats disposed over the openings of the table top;

a replacement table top; and a replacement modular display mat, wherein the table top and the replacement table top are each finished on both a top side and a bottom side such that each can be assembled together with the frame with either its top side or its bottom side facing up, wherein each of the modular display mats and replacement modular display mat can be swapped with each other to reconfigure the table.

14. The retail display system of claim 13, wherein the replacement table top has a different appearance from the table top.

15. The retail display system of claim 13, wherein at least two of the modular display mats and the replacement modular display mat have the same outer shape and different inner configurations.

16. The retail display system of claim 13, further comprising:

a non-table display fixture, comprising:

a display surface having openings therethrough; and modular display mats disposed over the openings of the display surface;

wherein each of the modular display mats of the non-table display fixture can be swapped with any of the modular display mats and replacement modular display mat of the table to reconfigure the non-table display fixture.

17. The retail display system of claim 16, wherein the non-table display fixture is a counter unit.

18. The retail display system of claim 16, wherein the non-table display fixture is a display wall.

19. The retail display system of claim 13, further comprising:

a display wall comprising:

a display wall frame; and a display wall insert disposed vertically within the display wall frame; and a replacement display wall insert having a different configuration from the display wall insert, wherein the display wall insert and the replacement display wall insert can be swapped with each other to reconfigure the display wall.

20. The retail display system of claim 13, further comprising:

modular floor tiles, each modular floor tile comprising:

a flat upper surface; and circular supports extending downward from the flat upper surface, wherein the circular supports support the flat upper surface; and a cable disposed under the modular floor tiles, the cable traversing between the circular supports, wherein the cable provides power to the table.

21. The retail display system of claim 13, further comprising:

a non-table display fixture, comprising:

a display surface having openings therethrough; and modular display mats disposed over the openings of the display surface;

a display wall comprising:

a display wall frame; and a display wall insert disposed vertically within the display wall frame;

a replacement display wall insert having a different configuration from the display wall insert;

modular floor tiles, each modular floor tile comprising:

a flat upper surface; and circular supports extending downward from the flat upper surface, wherein the circular supports support the flat upper surface; and a cable disposed under the modular floor tiles, the cable traversing between the circular supports, wherein the cable provides power to the table, the non-table display fixture, and the display wall, wherein each of the modular display mats of the non-table display fixture can be swapped with any of the modular display mats and replacement modular display mat of the table to reconfigure the non-table display fixture, and wherein the display wall insert and the replacement display wall insert can be swapped with each other to reconfigure the display wall.

22. The retail display system of claim 13, further comprising:

a floor system comprising:

subfloor tiles comprising a flat upper surface and circular supports extending downward from the flat upper surface; and carpet tiles disposed on top of the flat upper surface; and a display wall comprising:

a display wall frame;

support plates attached to a bottom section of the display wall frame, wherein the bottom section of the display wall frame is disposed to have an appearance of resting atop the carpet tiles, and wherein the support plates extend beneath the carpet tiles.

23. The retail display system of claim 22, wherein each of the support plates is surrounded by adjacent subfloor tiles, wherein each of the support plates has a width that is an integer multiple of a width of one of the surrounding adjacent subfloor tiles, wherein each of the support plates has a length that is an integer multiple of a length of one of the surrounding subfloor tiles, and wherein each of the support plates has a depth that is equal to the depth of one of the surrounding subfloor tiles.

* * * * *